US006778803B2

(12) United States Patent
Matsumoto

(10) Patent No.: US 6,778,803 B2
(45) Date of Patent: Aug. 17, 2004

(54) HEATING FIXING MECHANISM FOR USE IN IMAGE FORMING APPARATUS

(75) Inventor: Hirotaka Matsumoto, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/140,291

(22) Filed: May 8, 2002

(65) Prior Publication Data

US 2003/0210934 A1 Nov. 13, 2003

(51) Int. Cl.[7] ..... G03G 15/20
(52) U.S. Cl. ..... 399/324; 399/327
(58) Field of Search ..... 399/324, 325, 399/326, 327

(56) References Cited

U.S. PATENT DOCUMENTS

| | | | | |
|---|---|---|---|---|
| 4,557,588 A | * | 12/1985 | Tomosada | 399/324 |
| 6,314,252 B1 | | 11/2001 | Matsumoto | |
| 6,560,421 B1 | | 5/2003 | Matsumoto | |

FOREIGN PATENT DOCUMENTS

| | | |
|---|---|---|
| JP | 2-284184 | 11/1990 |
| JP | 5-204274 | 8/1993 |
| JP | 2000-98786 | 4/2000 |

* cited by examiner

*Primary Examiner*—Quana Grainger
(74) *Attorney, Agent, or Firm*—Foley & Lardner LLP

(57) ABSTRACT

According to the present invention, a member which can recover unnecessary toner is replaced with unused the member using parameters such as ambient temperature, temperature in the copying machine, density of image information, and step of setting temperatures of rollers on standby to be uniform at a predetermined timing.

12 Claims, 17 Drawing Sheets

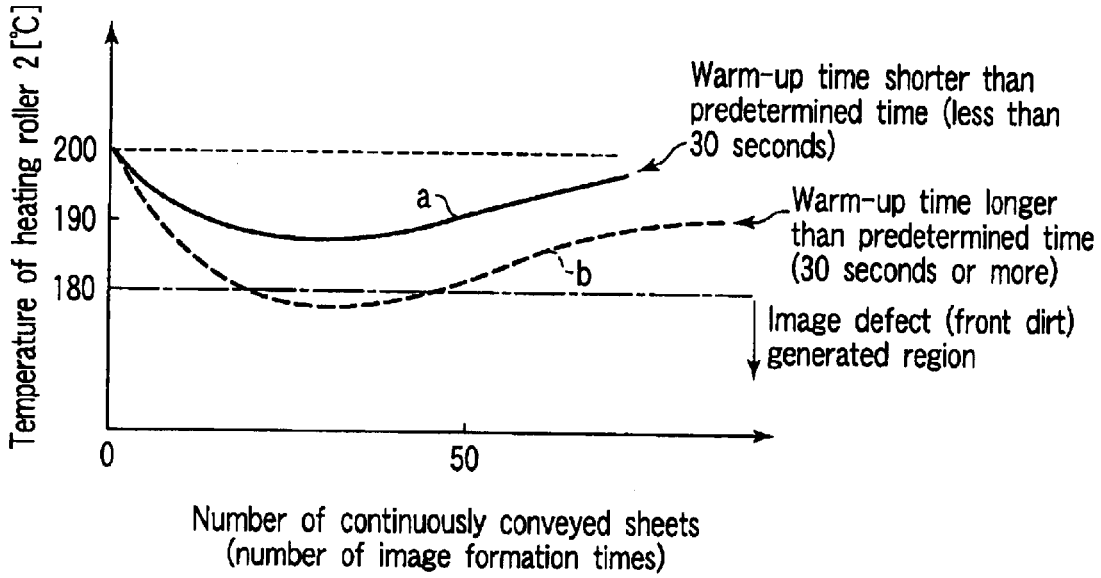

FIG. 5

| Warm-up time | Web feed amount control |
|---|---|
| 30 seconds or more | For web feed amount control during copy operation of 0 to 50 sheets from warm-up start, control of 0.45mm/time (=1.5 times normal) is performed |
| Less than 30 seconds | For web feed amount control during copy operation of 0 to 50 sheets from warm-up start, control of 0.30mm/time (=same as normal) is performed |
| Other than the above (normal) | For web feed amount control during copy operation, control of 0.30 mm/time is performed |

FIG. 6

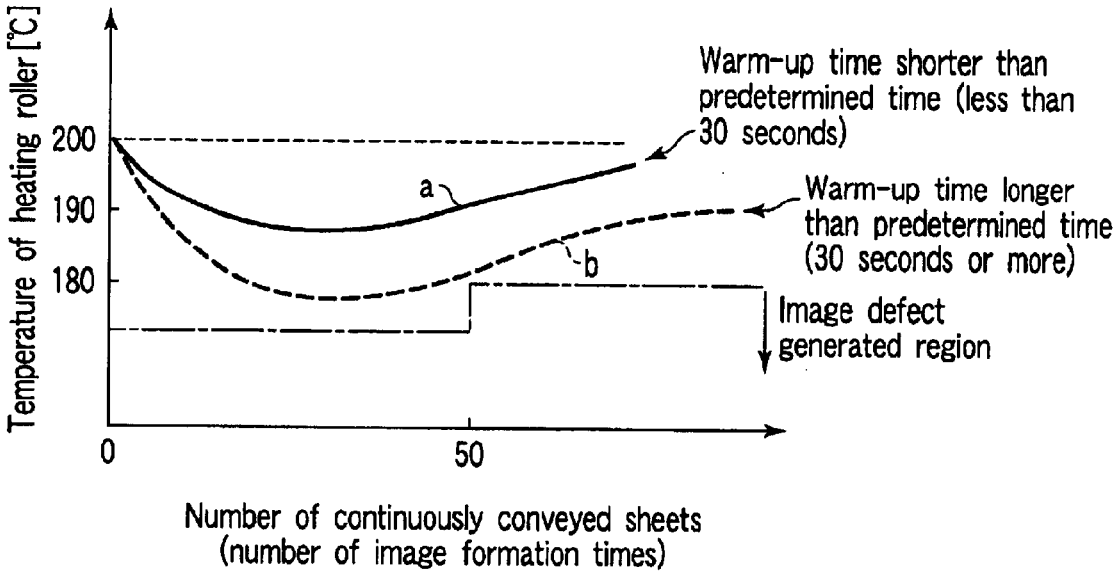

FIG. 8

| Condition of control | Copy speed and copy stop control | Web feed amount control |
|---|---|---|
| Temperature of heating roller is 171℃ or more | Copy speed 85 cpm | Perform web feed control at 0.3 mm/time |
| Temperature of heating roller for 165℃ or more but less than 171℃ | Copy speed 65 cpm | Perform web feed control at 0.6 mm/time (twice normal) |
| Temperature of heating roller for less than 165℃ | Copy operation stop ↓ Resume copy when temperature of heating roller returns to 200℃ | Perform 3.0 mm web feed operation immediately after stopping copy (move to new cleaning surface) |

FIG. 10

| Temperature of pressure-rised roller | Pre-run operation |
|---|---|
| 130℃ or more is detected | Pre-run operation is stopped |
| Less than 100℃ is detected | Pre-run operation is started |

| Total time of pre-run operation during ready | Web feed amount control |
|---|---|
| Less than 10 minutes | Perform web feed amount control of normal copy operation time (0.3 mm/time) |
| 10 minutes or more, but less than 20 minutes | Feed web by 1.5 mm simultaneously with copy operation start |
| 20 minutes or more | Perform web feed operation control by 3.0 mm (until new cleaning surface is obtained) simultaneously with copy operation start. After the operation ends, perform web feed amount control of normal copy operation time |

FIG. 16

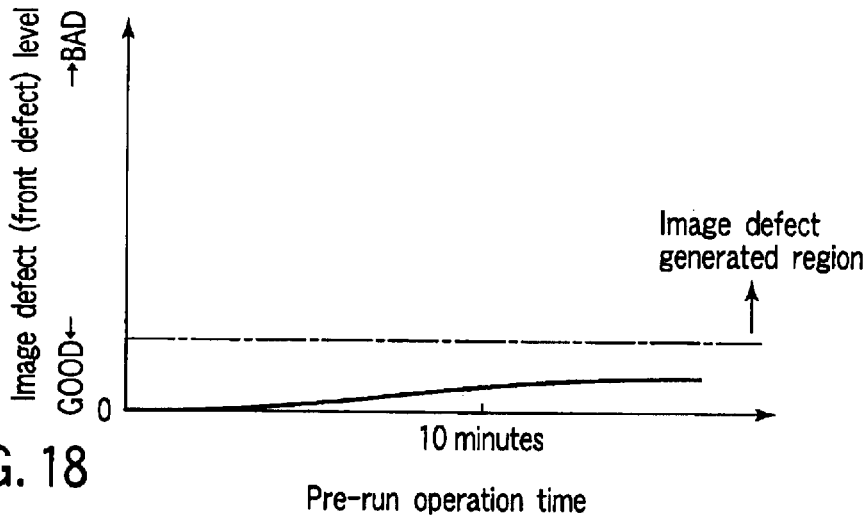

FIG. 18

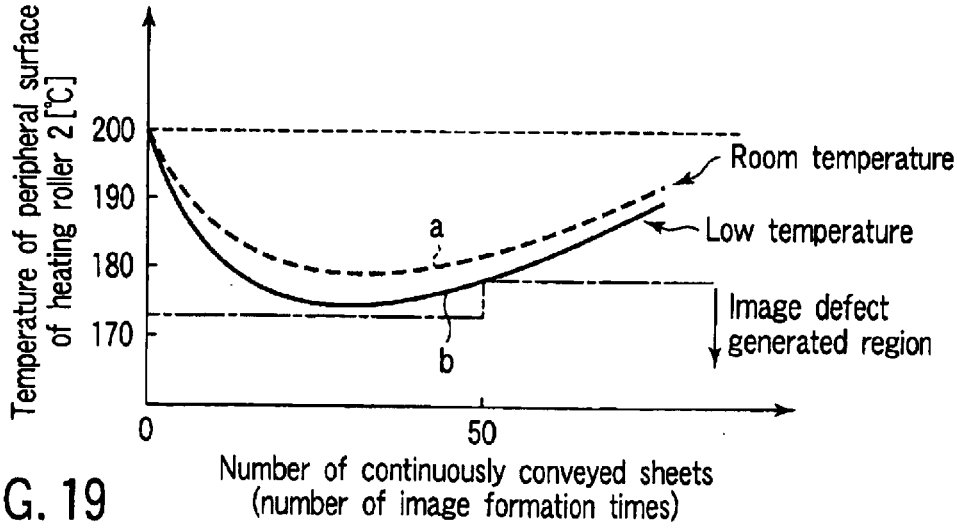

FIG. 19

| Condition for use | Warm-up time | Web feed amount control |
|---|---|---|
| 20℃ or more | 30 seconds or more | For web feed amount control during copy operation of 0 to 50 sheets immediately after warm-up, control of 0.45 mm/time (=1.5 times normal) is performed |
| | Less than 30 seconds | For web feed amount control during copy operation of 0 to 50 sheets immediately after warm-up, control of 0.30 mm/time (=same as normal) is performed |
| | Other than the above (normal) | For web feed amount control during copy operation, control of 0.30 mm/time is performed |
| Less than 20℃ | 30 seconds or more | For web feed amount control during copy operation of 0 to 50 sheets immediately after warm-up, control of 0.60 mm/time (=2.0 times normal) is performed |
| | Less than 30 seconds | For web feed amount control during copy operation of 0 to 50 sheets immediately after warm-up, control of 0.45 mm/time (=1.5 times normal) is performed |
| | Other than the above (normal) | For web feed amount control during copy operation, control of 0.30 mm/time is performed |

FIG. 20

| Web dirt adhering amount | Total time of pre-run operation during ready | Web feed amount control |
|---|---|---|
| Heavy (average image occupied ratio of 10% or more) | Less than 5 minutes | Web feed amount control of normal copy operation time is performed (0.3 mm/time) |
| | 5 minutes or more | Web feed operation control is performed by 3.0 mm (until obtaining new cleaning surface) simultaneously with copy operation start. After the operation ends, web feed amount control of normal copy operation time is performed |
| Medium (average image occupied ratio 5≦x<10%) | Less than 10 minutes | Web feed amount control of normal copy operation time is performed (0.3 mm/time) |
| | 10 minutes or more | Web feed operation control is performed by 3.0 mm (until obtaining new cleaning surface) simultaneously with copy operation start. After the operation ends, web feed amount control of normal copy operation time is performed |
| Light (average image occupied ratio of less than 5%) | Less than 30 minutes | Web feed amount control of normal copy operation time is performed (0.3 mm/time) |
| | 30 minutes or more | Web feed operation control is performed by 3.0 mm (until obtaining new cleaning surface) simultaneously with copy operation start. After the operation ends, web feed amount control of normal copy operation time is performed |

FIG. 23

HEATING FIXING MECHANISM FOR USE IN IMAGE FORMING APPARATUS

BACKGROUND OF THE INVENTION

The present invention relates to a fixing apparatus which is used in apparatuses using a toner, such as a copying machine and printer, and which fixes a toner image.

A fixing apparatus incorporated in a copying machine using an electrophotographic process heats and melts a developer or a toner formed on a transferred member to be fixed, and fixes the toner onto the transferred member to be fixed. Widely known examples of a method of heating the toner usable in the fixing apparatus include: a method of using radiant heat obtained by turning on a filament lamp; a flash heating method of using a flash lamp in a heat source; and the like. Additionally, in recent years, a fixing apparatus in which an induction heating apparatus is used as a heating source has been brought in practical use. Moreover, in many cases, a heating (fixing) roller with a heater set therein, and a pressure-rised roller pressed onto the heating roller at one point of an outer periphery of the heating roller at a predetermined pressure are used. According to the structure, it is easy to efficiently supply the heat from the heating source to the toner, and to apply a pressure for fixing the molten toner onto the transferred member to be fixed.

Additionally, in many of the toners used in a copying machine and a printer, a pigment or a dye is coated with a thermally fusible resin, and formed in a granular form or a powder. Therefore, in many cases, in a portion of the fixing apparatus brought in contact with the molten toner, a toner unfixed onto the transferred member to be fixed remains. Therefore, many fixing apparatuses in each of which a cleaning apparatus is added to the heating (fixing) roller brought in contact with the toner have been practically used.

A known general method of cleaning the fixing roller includes, bringing felt into contact with an outer peripheral surface of the heating roller; or supplying oil to inhibit the toner from adhering to the heating roller. Additionally, with the use of felt, since the toner adheres to a portion in contact with the heating roller, a method of forming the felt in a roller shape and inhibiting the toner from adhering to one position has been practically used.

On the other hand, it has been confirmed that even with the use of felt having the roller shape, the amount of fixable toner is reduced and an image defect is generated during a maintenance cycle. The image forming speed of the copying machine or the printer is enhanced, and/or the maintenance cycle of the copying machine or the printer is lengthened. Moreover, the felt with much toner adhering thereto is pressed onto the heating roller for a long time. These cause a problem that the surface of the heating roller is damaged.

To solve the problem, a web cleaning method has been brought in practical use, which includes, forming the felt in a web shape, and changing (displacing) a position of the felt contacting the heating roller in accordance with a total number of times of image formation (after elapse of a predetermined time).

With the use of the felt having the web shape, in a structure for successively taking up the web with the toner adhering thereto, when an amount of web is set in accordance with the maintenance cycle, the time to change the cleaning apparatus can be set. Additionally, the web is sometimes coated with oil for inhibiting the toner from adhering to the heating roller.

However, when the web shaped felt is used, the feed amount of web is constant. Therefore, immediately after the copying machine or the printer is turned on, such as at the beginning of the day (morning), temperature in the apparatus is low. Particularly, in low-temperature environments such as winter and high latitudes, the fixing apparatus reaches a predetermined standby temperature, but the temperature of the transferred member to be fixed or the toner is lower than an assumed temperature in many cases.

When an image forming output is output in this state, fixability of the toner fixed onto the transferred member to be fixed is close to a lower limit. Therefore, much toner adheres to the heating roller in many cases. This causes a problem that the amount of toner adhering to the web shaped felt increases as compared with the amount of toner adhering to the felt under normal use conditions.

Thereby, the felt becomes dirty in an accelerated manner. Regardless of the use of the taken-up web, there is a problem that the generation of the image defect and damaged heating roller cannot completely be eliminated.

Moreover, when the continuous image formation is repeated and the temperature of the heating roller of the fixing apparatus lowers, an interval of the supplying of the transferred member to be fixed and number of times of image formation are reduced or the supplying and image formation are stopped. Even in the copying machine or the printer in which this method is used, the feed amount of the web is constant.

Therefore, similarly as the above-described low-temperatures, the amount of the toner adhering to the heating roller increases as compared with the amount of the toner adhering under the normal use conditions.

Additionally, many copying machines and printers are accompanied with a pre-run operation of allowing the heating roller to idle in order to make heat distribution uniform, while the heating roller of the fixing apparatus is heated. Even in this case, the feed amount of the web is constant. Therefore, when much toner adheres to the heating roller, the amount of the toner fixed to the web disadvantageously increases. There is another problem that during the supplying of the oil from the web, the oil runs out and the recovered toner adhering to the web adheres to the heating roller again. Even in this case, as described above, the image defects and damaged heating roller are easily generated.

BRIEF SUMMARY OF THE INVENTION

An object of the present invention is to provide a fixing apparatus in which toner can be prevented from adhering to a print out output onto a member to be fixed.

According to the present invention, there is provided a fixing apparatus comprising:

a heating mechanism including:

- a heating object which is either a hollow cylinder or an endless belt, and in which a predetermined heat is supplied to a thermally fusible material and a base material holding the thermally fusible material, and either a peripheral surface of the cylinder or a belt surface of the belt, constituting the heating object, is moved at a predetermined speed;
- a pressure supply mechanism which supplies a predetermined pressure to the heating object with the thermally fusible material and base material between the pressure supply mechanism and the heating object, and whose peripheral surface is followed and moved by moving either the peripheral surface of the cylinder or the belt surface of the belt, constituting the heating object, at the predetermined speed;
- a heating object heating mechanism which is set in the heating object, and allows the heating object to generate heat;

a thermally fusible material recovering member which is brought in contact with the peripheral surface of the cylinder or the belt surface of the belt, constituting the heating object, at the predetermined pressure, and which can recover the thermally fusible material adhering to the peripheral surface of the cylinder or the belt surface of the belt;

a thermally fusible material recovering member renewing mechanism to move a region of the thermally fusible material recovering member brought in contact with the peripheral surface of the cylinder or the belt surface of the belt, constituting the heating object, at the predetermined pressure by a predetermined amount, when a predetermined amount of the thermally fusible material is absorbed by the thermally fusible material recovering member; and a heating object temperature detecting mechanism which detects a temperature of the peripheral surface of the cylinder or the belt surface of the belt, constituting the heating object; and a thermally fusible material recovering member renewing mechanism control apparatus which moves the region of the thermally fusible material recovering member brought into contact with the peripheral surface of the cylinder or the belt surface of the belt, constituting the heating object, at a predetermined timing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 5 is a schematic diagram showing one example of a change of temperature of a heating roller during output of print out immediately after end of warm-up, and an image defect, that is, a degree of generation of adhesion of a toner onto the surface of a fixing object as a transferred material, when a time required for warm-up is long immediately after turning on a copying machine or a printer, for example, at the beginning of the day, that is, first in the morning, in a low temperature in the fixing apparatus shown in FIGS. 2 and 3, especially in low-temperature environments such as winter and high latitudes, and when the temperature in the apparatus already rises to a predetermined temperature, and the time required for the warm-up is short;

FIG. 6 is a schematic diagram showing one example of a length of the warm-up time as the change of the temperature of the heating roller during the output of print out immediately after the warm-up ends and control over a feed amount of a web;

FIG. 8 is a schematic diagram showing that the control of the feed amount of the web shown in FIGS. 6 and 7 is used, and the image defect, that is, the degree of generation of adhesion of the toner onto the surface of the transferred material is reduced;

FIG. 10 is a schematic diagram showing one example of control of temperature of the heating roller for reducing the interval of the transferred material supply and the number of times of image formation or stopping the supply and image formation, when the print out is continuously output and thereby the temperature of the heating roller lowers as shown in FIG. 9;

FIG. 16 is a schematic diagram showing one example of the control of the feed amount of the web with respect to the total of the pre-run operation time shown in FIG. 15;

FIG. 18 is a schematic diagram showing that the control of the feed amount of the web shown in FIGS. 16 and 17 is used, and thereby the image defect, that is, the degree of generation of adhesion of the toner onto the surface of the transferred material is reduced;

FIG. 19 is a schematic diagram showing one example of the change of temperature of the heating roller during output of print out immediately after the end of warm-up, and the image defect, that is, the degree of generation of adhesion of the toner onto the surface of the transferred material, when a temperature of an environment with the apparatus set therein is lower than 20° C., and a time required for the warm-up is long, immediately after turning on the copying machine or the printer, for example, at the beginning of the day, that is, first in the morning, in a low temperature in the apparatus, and when the environment temperature with the apparatus set therein is higher than 20° C., and the time required for the warm-up is short;

FIG. 20 is a schematic diagram showing one example of the control of the web feed amount concerning the time required for outputting a certain constant number of copies of print out immediately after the warm-up in the low-temperature environment shown in FIG. 19;

FIG. 23 is a schematic diagram showing one example of the control of the feed amount of the web using the total of pre-run operation time and the amount of toner adhering to the web shown in FIG. 22 as parameters;

DETAILED DESCRIPTION OF THE INVENTION

A digital copying machine will be described hereinafter as one example of an image forming apparatus to which an embodiment of the present invention is applied with reference to the drawings.

Figure 1:
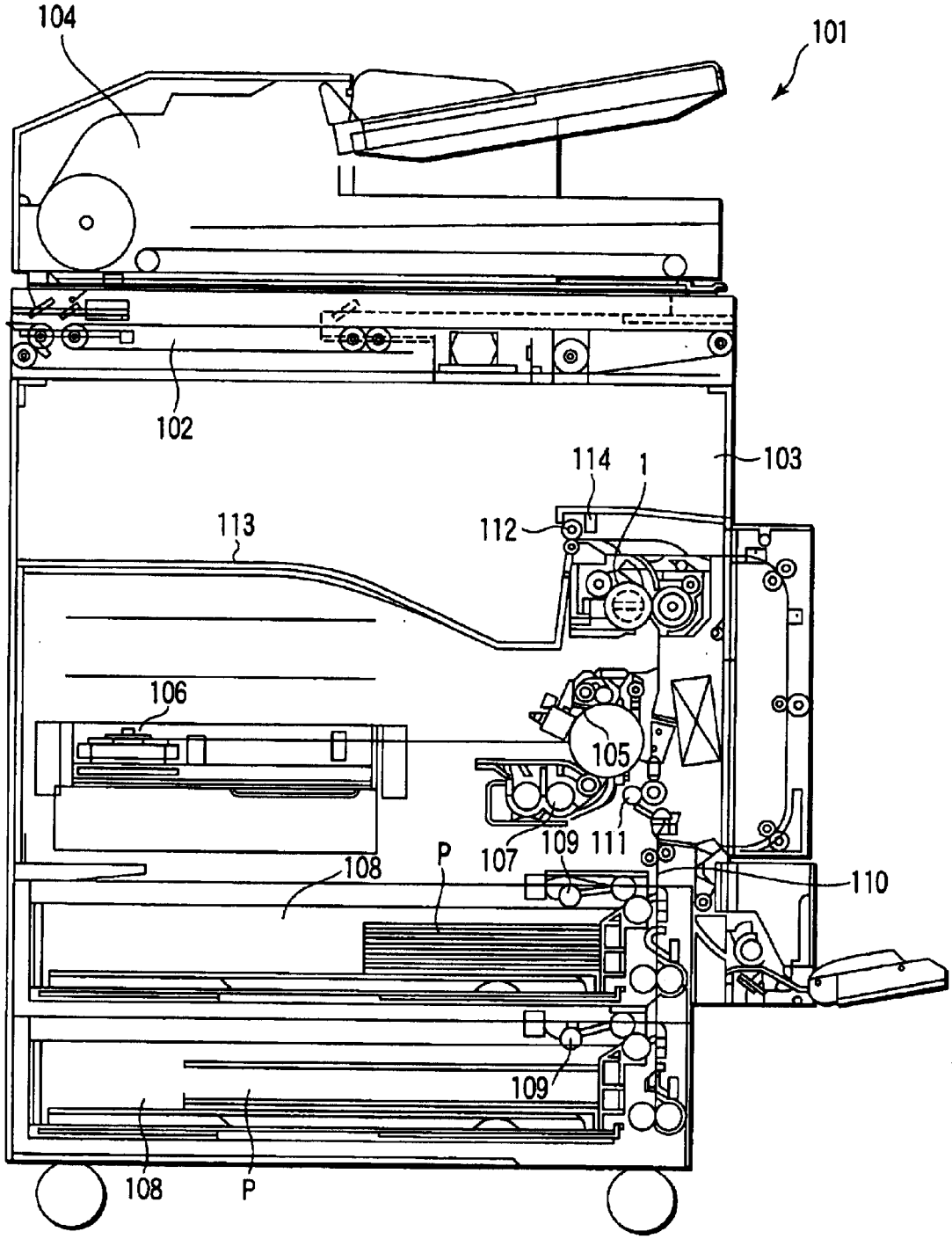
FIG. 1 is a schematic view showing one example of an image forming apparatus in which an induction heating fixing apparatus of the present invention is incorporated.

As shown in FIG. 1, a digital copying machine (image forming apparatus) 101 includes an image read apparatus (scanner) 102 for reading an image of an object as light and shade, photoelectrically converting the image, and for generating an image signal, and an image forming unit 103 for forming the image in response to the image signal supplied from the scanner 102 or the outside and fixing the image onto a sheet P as a transferred member to be fixed (transferred material). Additionally, in the scanner 102, an automatic draft feeder (ADF) 104 is integrally disposed to successively replace a copying object simultaneously with a read operation of the image by the scanner 102, when the copying object has a sheet shape.

The image forming unit 103 has a cylindrical photosensitive drum 105 having a photosensitive material formed in an outer peripheral surface thereof, which is given a predetermined potential and irradiated with light, whose potential of a region irradiated with the light thereby changes, and which can hold the change of the potential as an electrostatic image for a predetermined time.

The photosensitive drum 105 is exposed to image information from an exposure apparatus 106 which can output a laser beam having a light intensity changed in accordance with the image information supplied from the scanner 102 or an external apparatus. Thereby, the electrostatic image is formed on the photosensitive drum 105.

The image formed on the photosensitive drum 105 is visualized, when a toner (a developer) is selectively supplied by a developing apparatus 107.

A group of toner, that is, a toner image on the photosensitive drum 105 developed by supplying the toner by the developing apparatus 107 is transferred to the transferred material P supplied by a sheet supply conveyor section described hereinafter, when a voltage for transfer is supplied from a transfer apparatus herein described not in detail.

When a fixing apparatus 1 supplies heat and pressure, the toner image transferred to the transferred material P is molten, and fixed onto the transferred material P (by a pressure supplied by the fixing apparatus).

In this image forming apparatus, the image signal is supplied from the scanner 102 or the external apparatus, and a predetermined position of the photosensitive drum 105 charged beforehand at a predetermined potential is irradiated with the laser beam described not in detail from the exposure apparatus 106. The laser beam from the exposure apparatus 106 is modulated in intensity in response to the image signal. Thereby, an electrostatic latent image corresponding to the image to be copied (output) is formed on the photosensitive drum 105.

The electrostatic latent image formed on the photosensitive drum 105 is developed by selectively supplying the toner from the developing apparatus 107, and converted to a toner image (not shown).

The toner image on the photosensitive drum 105 is transferred to the transferred material, that is, the sheet P supplied to a transfer position disposed opposite to a transfer apparatus not denoted with a reference numeral. As not described in detail, the sheets P are taken out of sheet cassettes 108 sheet by sheet by pickup rollers 109, and conveyed beforehand to an aligning roller 111 in a conveyor path 110 defined between the photosensitive drum 105 and the cassettes 108. A supply timing is matched so that the sheet is aligned with the toner image formed on the photosensitive drum 105 by the aligning roller 111, and the sheet P is supplied to the transfer position.

The toner transferred to the sheet P by the transfer apparatus is carried to the fixing apparatus 1. The toner on the sheet P is molten and simultaneously pressurized, and fixed onto the sheet P by the fixing apparatus 1.

The sheet P with the toner image fixed thereto by the fixing apparatus 1 is discharged to a sheet discharge tray 113 as a space defined between the sheet cassettes 108 and scanner 102 by a sheet discharge roller 112, and laminated in order.

Figure 2:
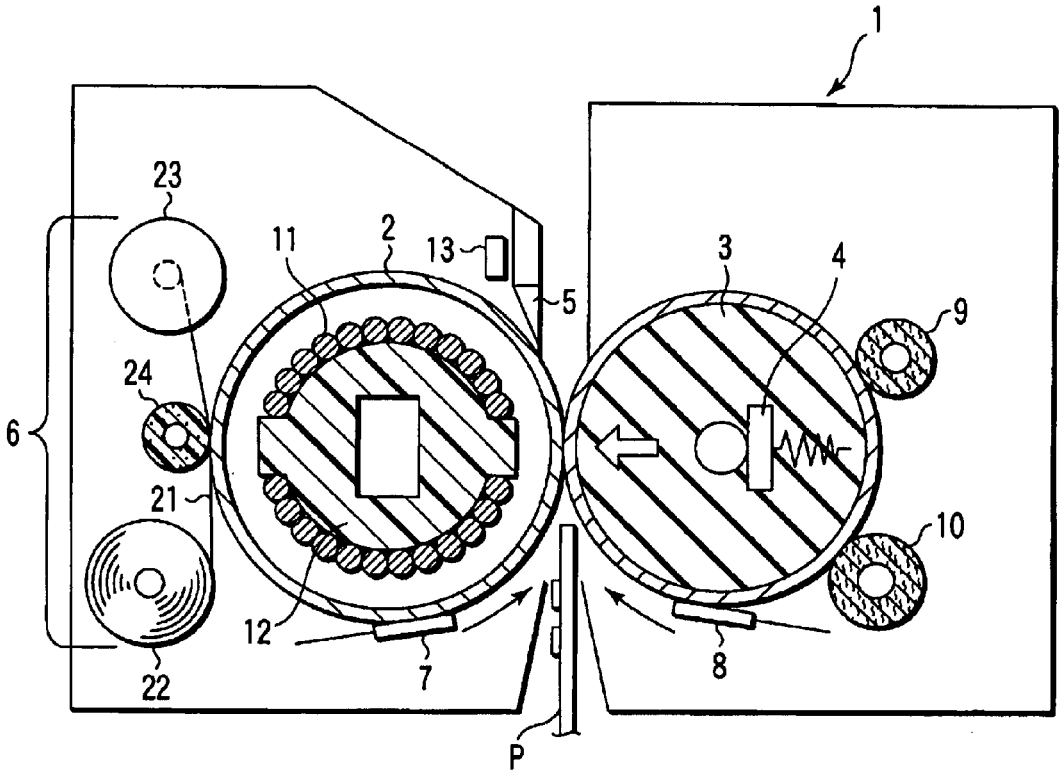
FIG. 2 is a schematic view showing one example of the induction heating fixing apparatus usable in the image forming apparatus shown in FIG. 1.
Figure 3:
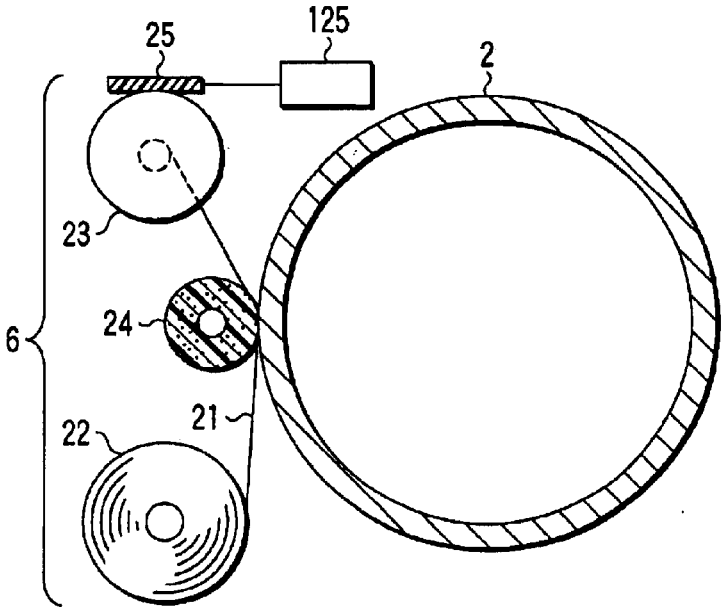
FIG. 3 is a schematic view showing one example of a web cleaning mechanism for use in the fixing apparatus shown in FIG. 2.

FIGS. 2 and 3 are schematic views showing one example of the fixing apparatus for use in the image forming apparatus shown in FIG. 1. Additionally, FIG. 3 shows a cleaner for a web method, integrally incorporated in the fixing apparatus 1 shown in FIG. 2 in detail.

The fixing apparatus 1 is constituted of a heating (fixing) roller 2 having a diameter of about 60 mm and a pressure-rised (press) roller 3 having a diameter of about 60 mm.

The heating roller 2 is a hollow cylindrical member formed of a metal, iron in this example, having a thickness of about 2 mm. A parting agent layer (not shown) having a predetermined deposited thickness of a fluorine resin represented by polytetrafluoroethylene (Teflon, tradename) is formed on the surface of the heating roller 2. As a roller material of the heating roller 2, stainless steel, aluminum, an alloy of stainless steel and aluminum, and the like can be used. In this example, a length of the heating roller 2 is about 340 mm. Additionally, instead of the heating roller 2, a metal film obtained by forming a sheet material of a metal deposited in a predetermined thickness in an endless belt shape on the surface of a resin film having a high heat resistance can also be used.

The pressure-rised roller 3 is an elastic roller in which the periphery of a shaft with a predetermined diameter is coated with a predetermined thickness of silicon rubber or fluorine rubber. The pressure-rised roller 3 has a length of about 320 mm.

The pressure-rised roller 3 is disposed substantially parallel to an axial line of the heating roller 2, and pressed into contact with the axial line of the heating roller 2 at a predetermined pressure by a pressure mechanism 4. Thereby, a part of the outer peripheral surface of the heating roller 2 is elastically deformed, and a predetermined nip is defined between the rollers. When the metal film is used instead of the heating roller 2, the nip is sometimes formed on a film side.

The heating roller 2 is rotated in an arrow direction at a substantially constant speed by a fixing motor 123 (see FIG. 4) or a drum motor 121 (see FIG. 4) for rotating the photosensitive drum 105.

When the heating roller 2 is rotated, the pressure-rised roller 3 is rotated together with the heating roller 2 at a constant speed. The pressure-rised roller is brought in contact with the heating roller 2 at a predetermined pressure by the pressure mechanism 4.

Therefore, a stripping claw 5 for stripping the sheet P passed through the nip from the heating roller 2 is positioned in a predetermined position on a downstream side in a direction in which the roller 2 is rotated from the nip (contact) of the heating roller 2 and pressure-rised roller 3 above the circumference of the heating roller 2, and in the vicinity of the nip.

In the periphery of the heating roller 2, a web cleaning mechanism 6 and thermistor 7 are arranged in order along the direction in which the roller 2 is rotated, and in a direction apart from the stripping claw 5.

The web cleaning mechanism 6 is used to remove the toner offset on the heating roller 2 and remove (clean) paper dust from the sheet as the transferred material, and to coat the mold release layer of the heating roller 2 with a mold release agent (e.g., silicone oil) for reduction of adhesion of the toner. The thermistor 7 is used to detect the temperature of the surface of the roller 2. Additionally, the thermistor 7 can be disposed in an optional position (in which it is unnecessary to set a phase as seen from a section direction) on the circumference of the roller 2. Moreover, two or more thermistors may be disposed.

On the outer peripheral surface of the pressure-rised roller 3, there are disposed a thermistor 8 for detecting the temperature of the peripheral surface of the pressure-rised roller 3, oil roller 9 for coating the peripheral surface of the pressure-rised roller 3 with the parting agent layer, for example, of silicone oil, and a cleaning roller 10 for removing the toner adhering to the peripheral surface of the pressure-rised roller 3.

Inside the heating roller 2, an exciting coil 11 for generating an eddy current is disposed in the material of the roller 2. The exciting coil 11 is formed in a length such that a width in contact with the outer peripheral surface of the roller 2 can be heated during the conveying of the sheet, for example, having an A4 size so as to align a short side of the sheet in parallel to the axial line of the roller 2.

The exciting coil 11 is formed by a litz wire obtained by bundling a plurality of copper wire materials each having a diameter, for example, of 0.5 mm and insulated from one another by polyamide imide having heat resistance, 16 wires in this example.

Since the exciting coil 11 is formed by the litz wire, a high-frequency current can effectively be passed. The diameter of each wire material can be set to be smaller than a penetration depth of a surface effect generated during the passing of a high-frequency alternating current through the wire material.

Therefore, the exciting coil 11 is a vacant core coil fixed to a coil holding member 12 formed, for example, by engineering plastics or ceramic having high heat resistance and indicating high insulation.

For example, a polyether ether ketone (PEEK) material, phenol material, unsaturated polyester, or the like can be used in the coil holding member 12.

Moreover, for a winding method of the wire material forming the exciting coil 11, an optional winding method can be used. In the example shown in FIG. 2, the shape of the coil holding member 12 is characterized, and the coil has a shape of a plane coil extending along an inner periphery of the heating roller 2.

Additionally, a density sensor 13 for monitoring a degree of toner (offset toner) adhering to the surface of the roller 2 is disposed in the predetermined position in the vicinity of the outer peripheral surface of the heating roller 2, for example, in the vicinity of the stripping claw 5.

One example of the web cleaning mechanism 6 will next be described with reference to FIG. 3.

The web cleaning mechanism 6 includes a web supply member 22 around which a predetermined amount (length) of web 21, for example, obtained by forming a chemical fiber bearing the heat of the heating roller 2 into a felt-like sheet material is wound, and a web recovering member 23 which takes up each predetermined amount of web 21. Additionally, a predetermined amount of silicone oil as the parting agent is absorbed beforehand in the web 21. Moreover, the web 21 has a thickness, for example, of 54 $\mu$m.

Between the web supply member 22 and web recovering member 23, a tension roller 24 for bringing the web 21 extended to the web recovering member 23 from the web supply member 22 into contact with the peripheral surface of the heating roller 2 at a predetermined pressure is positioned.

Therefore, when the heating roller 2 is rotated, the optional region of the peripheral surface of the heating roller 2 constantly contacts the web 21. Thereby, the predetermined amount of silicone oil is supplied, and a thin layer of the oil is formed on the peripheral surface of the heating roller 2.

Additionally, the tension roller 24 has a sponge shape, for example, having hardness of 30° and outer diameter of 20 mm. Moreover, when the web 21 is recovered by the web recovering member 23 by a driving mechanism described hereinafter, and the web 21 is moved, the tension roller 24 follows the movement of the web 21, and is rotated little by little. Thereby, a pressure in pressing the web 21 onto the pressure-rised roller 3 is prevented from fluctuating. Since the roller 24 is elastically deformed.

Figure 4:
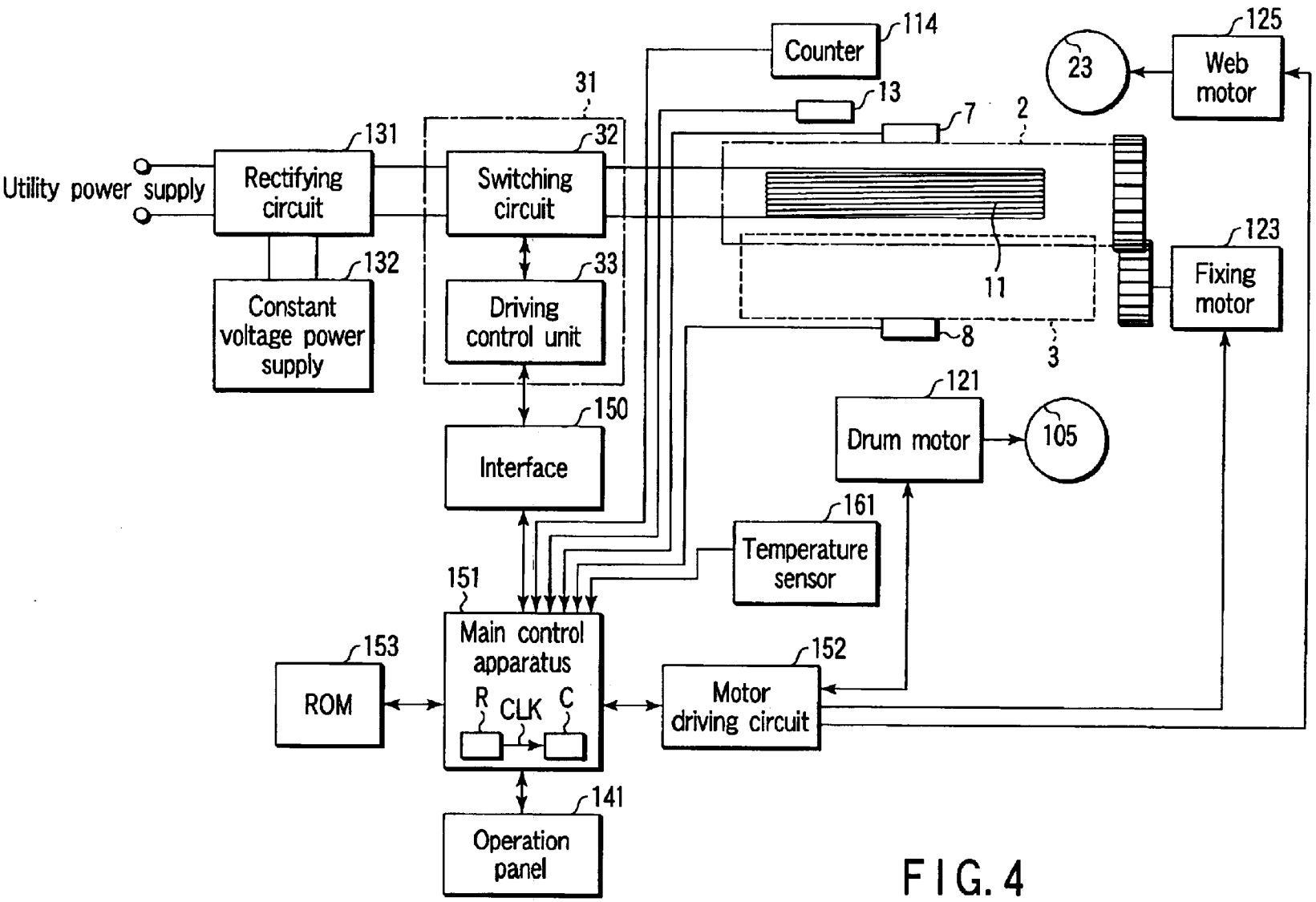
FIG. 4 is a schematic block diagram showing a control system of the fixing apparatus shown in FIGS. 2 and 3 and image forming apparatus shown in FIG. 1.

The web recovering member 23 is rotated by a web recovering motor 125 (see FIG. 4). For example, the web recovering member 23 is rotated every predetermined amount (rotation angle) at a predetermined timing by a rotation transmission mechanism 25 including a one of a gear train, a belt, and a wheel set. Additionally, an amount of the web 21 moved once (hereinafter referred to as a web feed amount) is set to 0.3 mm every ten times of image formation (output of ten copies of print out) in the fixing apparatus shown in FIG. 2 and the digital copying machine 101 shown in FIG. 1.

FIG. 4 is a schematic diagram showing one example of a control circuit block for operating the fixing apparatus and web cleaner shown in FIGS. 2 and 3.

The exciting coil 11 for generating the eddy current and generating the heat in the metal material of the heating roller 2 as described above is contained in the heating roller 2 of the fixing apparatus 1. The exciting coil 11 is connected to an exciting unit 31 which supplies a high-frequency output with a predetermined frequency to the exciting coil 11.

The exciting unit 31 includes a switching circuit 32 which can output a high-frequency output with the predetermined frequency to be supplied to opposite ends of the exciting coil 11, and a driving control unit 33 which supplies a control signal for outputting the high-frequency output with the predetermined frequency to the switching circuit 32. A direct-current voltage is supplied to the switching circuit 32 from a rectifying circuit 131 which receives an Utility power supply, rectifies an alternating-current voltage and supplies a direct-current voltage. Additionally, a driving voltage obtained by setting the rectified output outputted from the rectifying circuit 131 to be constant in a constant voltage circuit 132 is used in the driving control unit 33 in order to suppress an influence of change of the voltage returned via is the switching circuit 32 by the change of the output of the exciting coil 11.

The driving control unit 33 is connected to a main control apparatus 151 on an image forming unit 103 side via an interface 150. Additionally, the driving control unit 33 obtains a frequency to be outputted by the switching circuit 32 in response to an output of the thermistor 7 as a detection output indicating the detected temperature of the peripheral surface of the heating roller 2, an output of the thermistor 8 as a detection output indicating the detected temperature of the pressure-rised roller 3, and a control signal input from the image forming unit 103, and sets the high-frequency output to be outputted by the switching circuit 32.

The main control apparatus 151 on the image forming unit 103 side is connected to a motor driving circuit 152 which rotates a motor described hereinafter at a predetermined rotation number (speed).

For example, in the copying machine 101 shown in FIG. 1, the drum motor 121 for rotating the photosensitive drum 105 at the predetermined rotation number, the fixing motor 123 for rotating the heating roller 2 of the fixing apparatus 1, and the web motor 125 for rotating the web recovering member 23 of the web cleaner 6 are used.

Therefore, when the main control apparatus 151 instructs the rotation of the optional motor, the motor driving circuit 152 supplies a predetermined number of motor driving pulses to the corresponding motor. Additionally, as described above, in some case, the fixing motor 123 is omitted, and the rotation of the drum motor 121 is transmitted to the heating roller 2.

Moreover, the main control apparatus 151 is connected to a counter for checking that the sheet with the toner completely fixed thereto by the fixing apparatus 1 is discharged. Additionally, for example, an output of a discharge jam sensor 114 can be used as a count value.

A web feed amount corresponding to the timing (condition) and individual conditions for moving the web 21, that is, an amount of rotation of the web recovering member 23 can be supplied to the main control apparatus 151, for example, from a ROM 153. Additionally, the web feed amount stored in the ROM 153 can optionally be changed, for example, from a control panel 141 connected to the main control apparatus 151.

The main control apparatus 151 is also connected to a temperature sensor 161 which detects the temperature of the predetermined position inside the image forming unit 103, for example, the temperature of the vicinity of the photosensitive drum 105. Additionally, the main control apparatus 151 (may be the driving control unit 33) includes a clock generator R for outputting a clock CLK and counter C for counting the clock CLK generated by the clock generator R, for example, as firmware (or additional elements).

The control of the web feed amount as a characteristic of the present invention will be described hereinafter in detail.

FIG. 5 shows a time from start of heating of the heating roller of the fixing apparatus shown in FIGS. 2 and 3 till end of warm-up, and an image defect, that is, a degree of generation of adhesion of the toner onto the surface of the sheet as the transferred material.

In FIG. 5, a curve b shows a state of fluctuation of temperature of the heating roller 2 in repeating a continuous image forming operation immediately after the end of the warm-up in a case in which a time required for the warm-up is longer than a predetermined time described hereinafter immediately after turning on the copying machine 101, for example, at the beginning of the day, in a low temperature in the apparatus, especially in low-temperature environments such as winter and high latitudes. Additionally, as an example of the warm-up time longer than the predetermined time, the time is 30 seconds or more in a case in which the copying machine 101 shown in FIG. 1 includes the fixing apparatus 1 shown in FIGS. 2 and 3. Needless to say, the warm-up time is separately set depending on the number of copies of print out per minute required for the copying machine 101 and/or a power situation (maximum input power) of a country or a district in which the copying machine 101 is installed.

A curve a shows that the temperature of the heating roller 2 changes during continuous print out, and a temperature of 180° C. or more is secured regardless of the number of times (copies) of print out, in a case in which the above-described warm-up time is shorter than the predetermined time (30 seconds in this example), and the temperature of the heating roller 2 of the fixing apparatus 1 is about 200° C. on standby.

On the other hand, as shown by the curve b, even when the temperature of the heating roller 2 of the fixing apparatus 1 is about 200° C. during standby, the temperature becomes lower than 180° C. by the continuous output of print out, and the generation of the image defect is recognized. Additionally, as apparent from FIG. 5, when the number of continuously conveyed sheets (number of image formation times) exceeds 50, the temperature inside the copying machine 101 also rises, and the temperature of the heating roller 2 is not less than 180° C. Therefore, as a cause for the generation of the image defect, for example, the warm-up time for obtaining the standby temperature of the heating roller 2 is longer than the predetermined time. Even in this case, it is seen that only the time required for raising the temperature inside the copying machine 101 may be considered.

FIG. 6 shows one example of a length of the warm-up time and control of the feed amount of the web of the web cleaner shown in FIG. 3 with respect to the change of the temperature of the heating roller during the output of the print out immediately after the end of the warm-up shown in FIG. 5.

As apparent from FIG. 6, when the warm-up time is longer than the predetermined time, and until the number of times of output of print out reaches 50 times (50 copies), the feed amount of the web 21 in the web cleaner 6 is 1.5 times that of the normal operation time described above. It has been confirmed that the image defect is not easily generated by the feed control of the web 21.

Additionally, since the feed amount of the web 21 is 0.3 mm every 10 sheets of image formation during the normal operation, the web feed amount is 0.45 mm per time in the above-described low-temperature environment.

In this case, for the feed amount of the web 21, referring to the temperature of the peripheral surface of the heating roller 2 of the fixing apparatus 1 detected by the thermistor 7 and the time for the thermistor 7 to detect the predetermined temperature counted by the counter C, the main control apparatus 151 reads temperature control conditions stored in the ROM 153.

Subsequently, the read temperature condition is corrected based on the temperature in the copying machine detected by the temperature sensor 161 disposed in the image forming unit 103 of the copying machine 101 shown in FIG. 4.

Thereafter, the main control apparatus 151 indicates the time to rotate the web motor 125 (i.e., the number of motor driving pulses) to the motor driving circuit 152. Thereby, the motor driving circuit 152 supplies the predetermined number of motor driving pulses to the web motor 125, and the web recovering member 23 of the web cleaner 6 is rotated by the predetermined amount. Therefore, a predetermined length of web 21 of the web cleaner 6 is taken up by the web recovering member 23.

Figure 7:
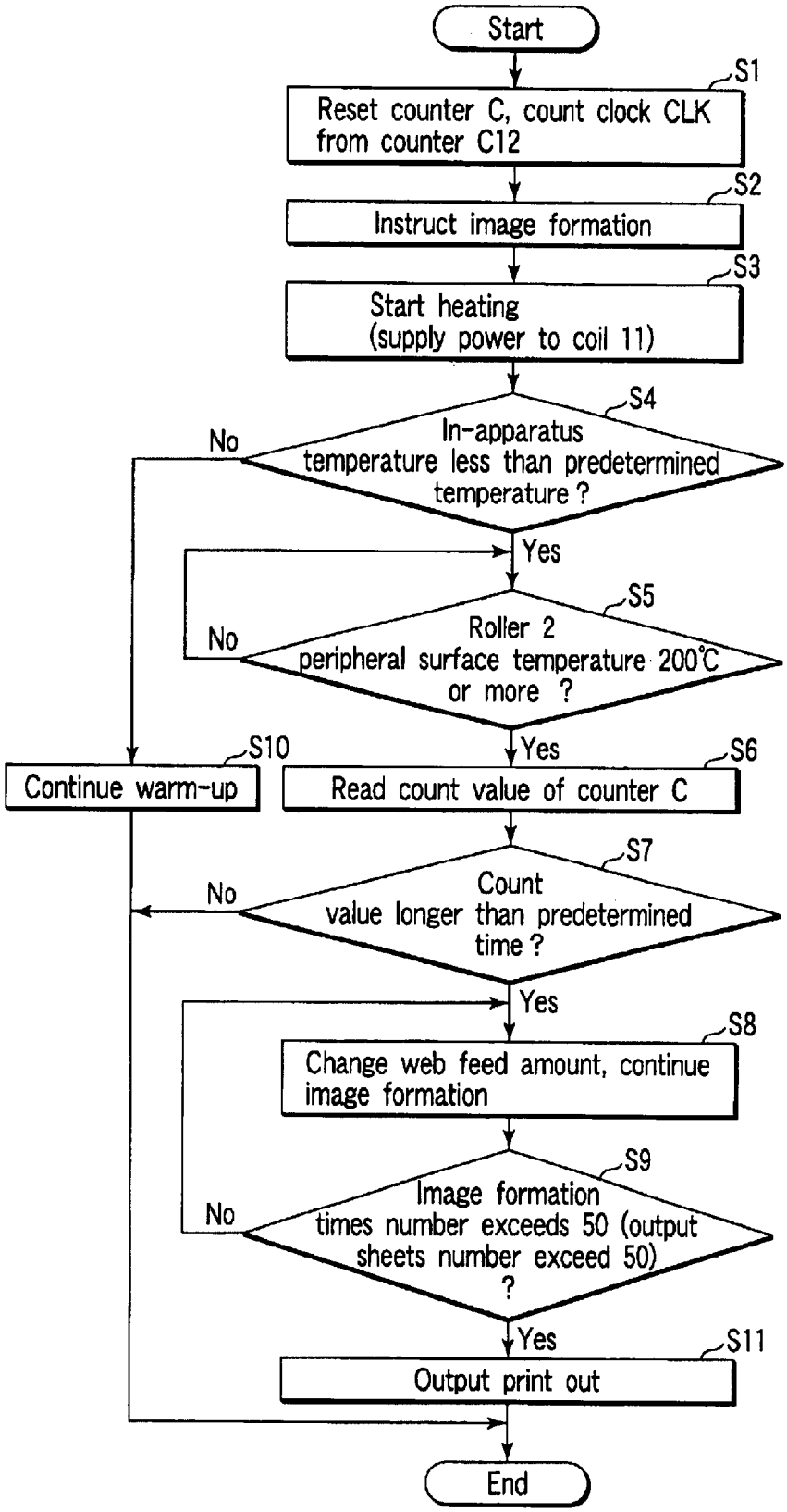
FIG. 7 is a flowchart showing one example of the control of the feed amount of the web shown in FIG. 6 in detail.

FIG. 7 is a flowchart showing one example of the control of the feed amount of the web shown in FIG. 6 in detail.

As shown in FIG. 7, when a power switch (not shown) of the copying machine 101 is turned ON, the counter C as the firmware of the main control apparatus 151 (or added to the main control apparatus 151) is reset, and simultaneously the clock CLK generated by the clock generator R is counted (S1).

An operation start of an image formation is input from the control panel 141, the output of print out (image formation) with respect to the image information read by the ADF 104 or the image information supplied from the external apparatus (S2). The temperature of the heating roller 2 is raised. Since, the high-frequency output with the predetermined frequency is supplied to the exciting coil 11 (S3).

While the temperature of the heating roller 2 is raised, the temperature in the copying machine 101 detected by the temperature sensor 161 disposed in the image forming unit 103 is referred to (S4).

Subsequently, based on the temperature in the copying machine 101 detected by the temperature sensor 161, it is judged whether the warm-up starts from the cold state, for example, first in the morning (power turning-on in the low-temperature environment) (S4—Yes), or whether the conditions are normal (the temperature in the copying machine 101 is not less than the predetermined temperature) (S4—No). On the normal conditions (S4—No), the normal warm-up operation is continued as it is (S9).

When the normal warm-up operation is continued by the step S9, the image corresponding to the image information is formed in a normal routine whose timing is matched with other element operations by the input of copy start from the control panel 141 (S10).

It is judged that the power is turned on in the low-temperature environment (S4—Yes). In this case, the thermistor 7 monitors the temperature of the peripheral surface of the heating roller 2 of the fixing apparatus 1, and it is monitored whether or not the temperature of the peripheral surface of the roller 2 reaches the predetermined temperature, for example, of 200° C. (S5).

The thermistor 7 detects that the temperature of the peripheral surface of the heating roller 2 has reached 200° C. (S5—Yes), and the count value by the counter C, that is, the time from when the power is turned on until the temperature of the peripheral surface of the roller 2 reaches 200° C. is calculated (S6).

It is judged whether or not the count value counted by the counter C, that is, the heating time for the warm-up is longer than the predetermined time, for example, of about 30 seconds in a case in which the copying machine 101 shown in FIG. 1 includes the fixing apparatus 1 shown in FIGS. 2 and 3, and a high-frequency output capable of outputting a heat equivalent to 1200 W is input to the exciting coil 11 (S7). When the heating time for the warm-up is shorter than 30 seconds (S7—No), the print out is formed as it is at the predetermined timing (S10).

When the heating time for the warm-up is longer than 30 seconds (S7—Yes), the main control apparatus 151 refers to the ROM 153. The image forming routine for the warm-up in a case in which the internal temperature of the copying machine 101 is lower than the predetermined temperature is set. In one example, the take-up amount of the web 21 stored in the ROM 153 (web feed amount) is changed to 0.45 mm/10 sheets from 0.3 mm/10 sheets (S8).

Moreover, referring to the count value of the counter 114 for counting the number of discharged sheets with the image completely formed thereon, it is judged whether or not the number of continuously discharged sheets has reached 50 (the number of times of image formation has reached 50) following the first discharged sheet with the image completely formed thereon (S9). When the number of times of continuous image formation has reached 50 (S9—Yes), the predetermined number of copies of print out is output by a normal routine shown in step SY. In this case, the take-up amount of the web 21 set in step S8 is also returned to a first set value.

On the other hand, the number of continuously discharged sheets with the image completely formed thereon does not reach 50 (the number of times of image formation has reached 50) following the first discharged sheet with the image completely formed thereon (S9—No).

In this case, turning back to the step S4, the take-up amount of the web 21 of the web cleaner 6 is set again based on the temperature in the apparatus 101 detected by the temperature sensor 161 (S4 to S8).

As apparent from FIG. 8, it is recognized that with use of the control of the feed amount of the web shown in FIGS. 6 and 7, the degree of generation of image defects (adhesion of toner onto the surface of the sheet (transferred material)) is reduced. That is, when the feed amount of the web 21 of the web cleaner 6 is optimized without changing the condition of temperature control concerning the fixing apparatus 1, and even when the temperature of the peripheral surface of the heating roller 2 temporarily drops, the image defect such as toner dirt can be inhibited from being generated. Therefore, it is possible to obtain the print out having little dirt by the toner without decreasing the number of outputs of print out per unit time.

Figure 9A:
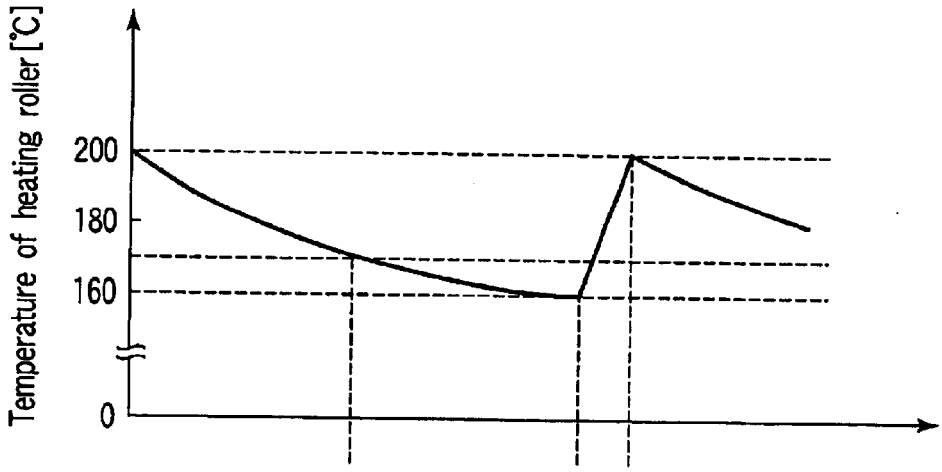
FIG. 9A is a schematic diagram showing one example of the change of temperature of the heating roller by reducing an interval of the transferred material supply and the number of times of image formation or stopping the supply and image formation, when the fixing apparatus shown in FIGS. 2 and 3 is used to continuously output the print out and thereby the temperature of the heating roller lowers.
Figure 9B:
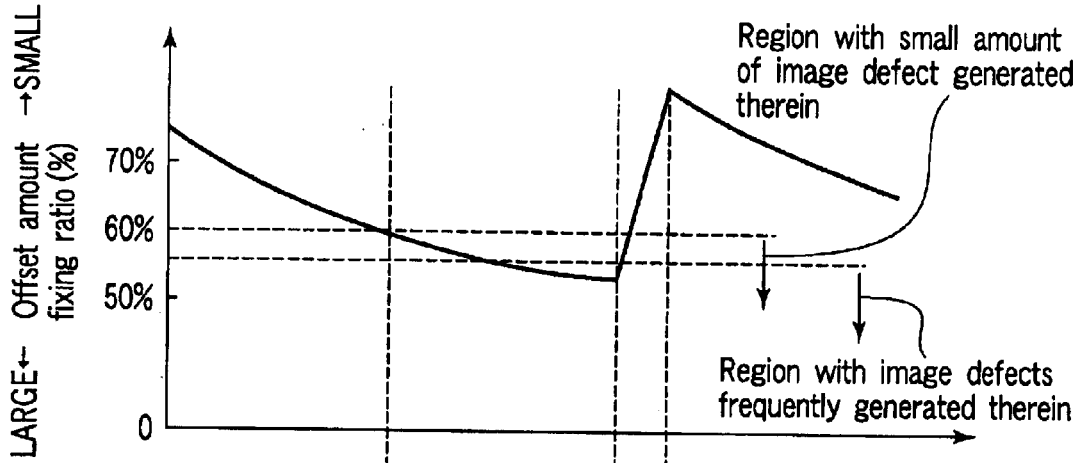
FIG. 9B is a schematic diagram showing a change of a fixing ratio by reducing the interval of the transferred material supply and the number of times of image formation or stopping the supply and image formation, when the fixing apparatus shown in FIGS. 2 and 3 is used to continuously output the print out and thereby the temperature of the heating roller lowers.
Figure 9C:
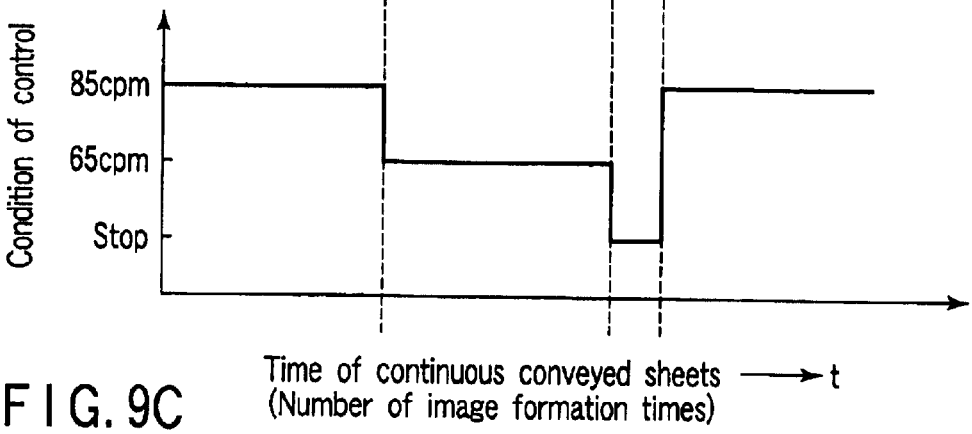
FIG. 9C is a schematic diagram showing the image defect, that is, the degree of generation of adhesion of the toner onto the surface of the transferred material by reducing the interval of the transferred material supply and the number of times of image formation or stopping the supply and image formation, when the fixing apparatus shown in FIGS. 2 and 3 is used to continuously output the print out and thereby the temperature of the heating roller lowers.

FIGS. 9A and 9B show relations between the time for continuously outputting the print out, that is, the number of times of image formation, the temperature of the peripheral surface of the heating roller, and a fixing ratio of toner fixed onto the sheet in a case in which the copying machine shown in FIG. 1 includes the fixing apparatus shown in FIGS. 2 and 3, the temperature of the heating roller drops by the continuous output of the print out, and then a control over image formation is also performed to reduce or stop an interval to supply the transferred material, that is, the sheet and the number of times of image formation.

FIG. 10 shows the change of the temperature of the heating roller depending on the number of times of continuous image formation shown in FIGS. 9A and 9B and one example of the control of feed amount of web of web cleaner.

As apparent from FIG. 10, when the temperature of the peripheral surface of the heating roller 2 detected by the thermistor 7 is higher than, for example, 171° C., the number of times of output of print out is set to 85 copies per minute (CPM). In this case, the feed amount of the web 21 of the web cleaner 6 is a normal feed amount of 0.3 mm/10 sheets.

On the other hand, when the temperature of the peripheral surface of the heating roller 2 is, for example, below 171° C., but is 165° C. or more, the number of times of output of the print out is limited to 65 copies per minute.

In this case, the feed amount of the web 21 of the web cleaner 6 is twice the normal feed amount, and is set to 0.6 mm/10 sheets.

On the other hand, when the temperature of the peripheral surface of the heating roller 2 is, for example, below 165° C., the rotation of the heating roller 2 is temporarily stopped. Additionally, thereafter, for example, 3 mm of web 21 is taken up at a predetermined timing, until the temperature of the heating roller 2 is raised and the roller is again rotated. Moreover, about 20 seconds are necessary for raising the temperature of the heating roller 2 to 200° C. from 165° C. Moreover, when the temperature of the peripheral surface of the heating roller 2 exceeds 171° C., the print out is output again.

Figure 11:
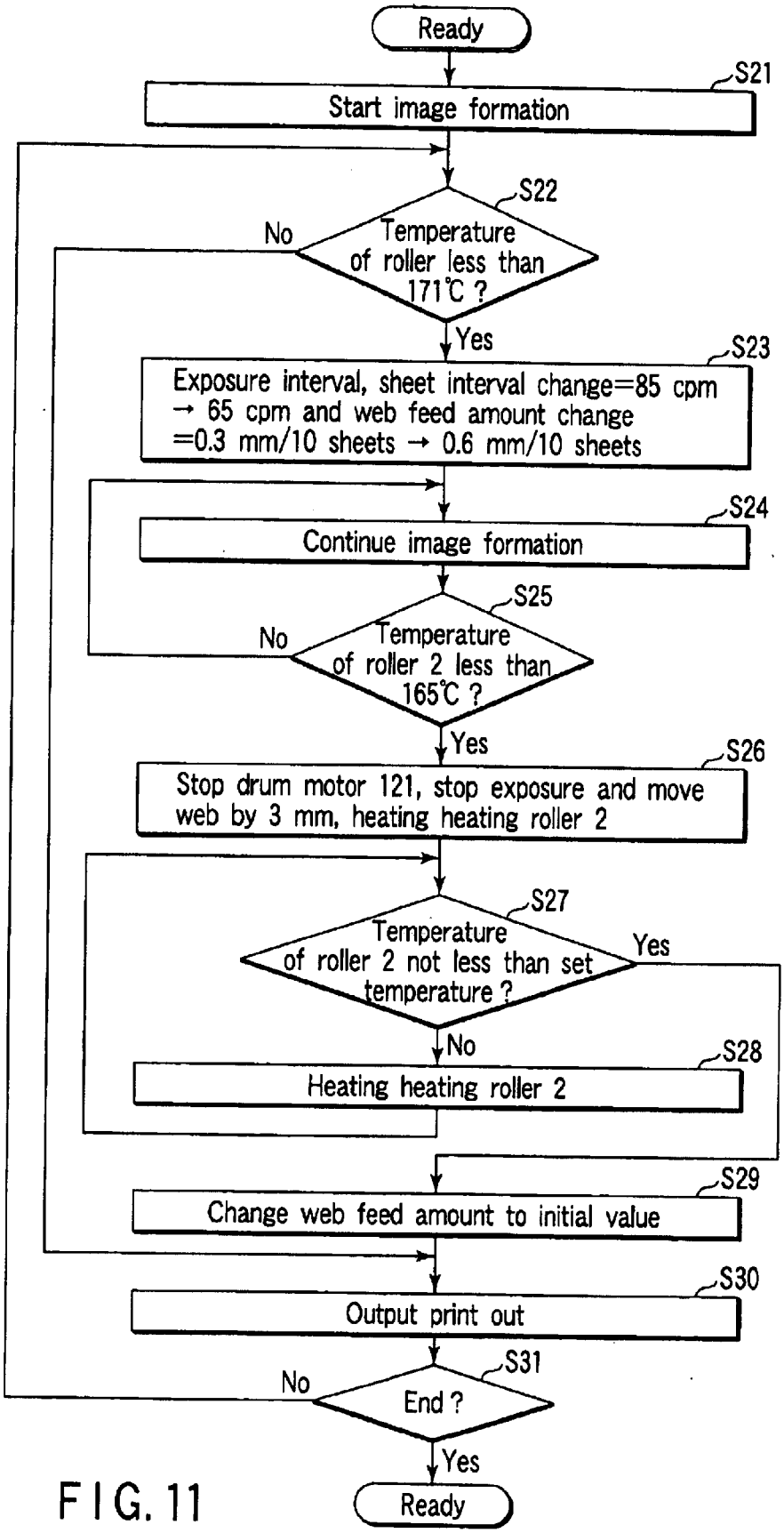
FIG. 11 is a flowchart showing one example of the control of the feed amount of the web shown in FIG. 10 in detail.

FIG. 11 is a flowchart showing one example of the control of feed amount of the web shown in FIG. 10 in detail.

As shown in FIG. 11, when the warm-up ends, and the output of continuous print out is instructed to the copying machine 101 via the control panel 141, the high-frequency output having the predetermined frequency is supplied to the exciting coil 11 of the fixing apparatus 1. Thereafter, the image corresponding to the image information is formed in the normal routine whose timing is matched with the other element operations by the input of copy start from the control panel 141 (S21).

Subsequently, the thermistor 7 monitors the temperature of the peripheral surface of the heating roller 2, and it is judged whether or not the temperature of the peripheral surface of the roller 2 is below 171° C. (S22).

The thermistor 7 detects that the temperature of the peripheral surface of the heating roller 2 is below 171° C. (S22—Yes), and then an interval to output an image light and an interval to supply the sheet are changed to an interval of 65 sheets per minute from an interval of 85 sheets per minute by a unit of one copy of print out emitted to the photosensitive drum 105 from the exposure apparatus 106. Additionally, the feed amount of the web 21 of the web cleaner 6 is changed to 0.6 mm/10 sheets from 0.3 mm/10 sheets.

That is, a timing at which the web motor 125 is driven is the same (once per ten times of image formation), but a rotation amount of the motor 125 is doubled (S23).

Furthermore, when the output of print out is continued (S24), the thermistor 7 continuously detects the temperature of the peripheral surface of the heating roller 2 at a predetermined timing (S25).

In step S25, it is detected that the temperature of the peripheral surface of the heating roller 2 is below 165° C. (S25—Yes), and the main control apparatus 151 stops the fixing motor 123. Simultaneously and/or at the predetermined timing, the web motor 125 is rotated by the predetermined amount, and the web 21 is taken up, for example, by 3 mm. That is, the web 21 brought in contact with the peripheral surface of the heating roller 2 is changed. Therefore, the temperature of the roller 2 is rapidly raised (S26).

Thereafter, the high-frequency output having the predetermined frequency is supplied to the exciting coil 11, and the temperature of the roller 2 is raised (S28), until the temperature of the peripheral surface of the heating roller 2 detected by the thermistor 7 exceeds a set temperature, such as 171° C. and/or 200° C. (S27—No).

When the temperature of the peripheral surface of the heating roller 2 detected by the thermistor 7 exceeds the set temperature (S27—Yes), the interval to output the image light and the interval to supply the sheet are changed to an interval of 85 sheets per minute from an interval of 65 sheets per minute by the unit of one copy of print out emitted to the photosensitive drum 105 from the exposure apparatus 106. Additionally, the feed amount of the web 21 is changed to 0.3 mm/10 sheets (S29). Subsequently, the image formation is repeated until all the planned image formations end (S30, S31).

Figures 12A, 12B, 13:
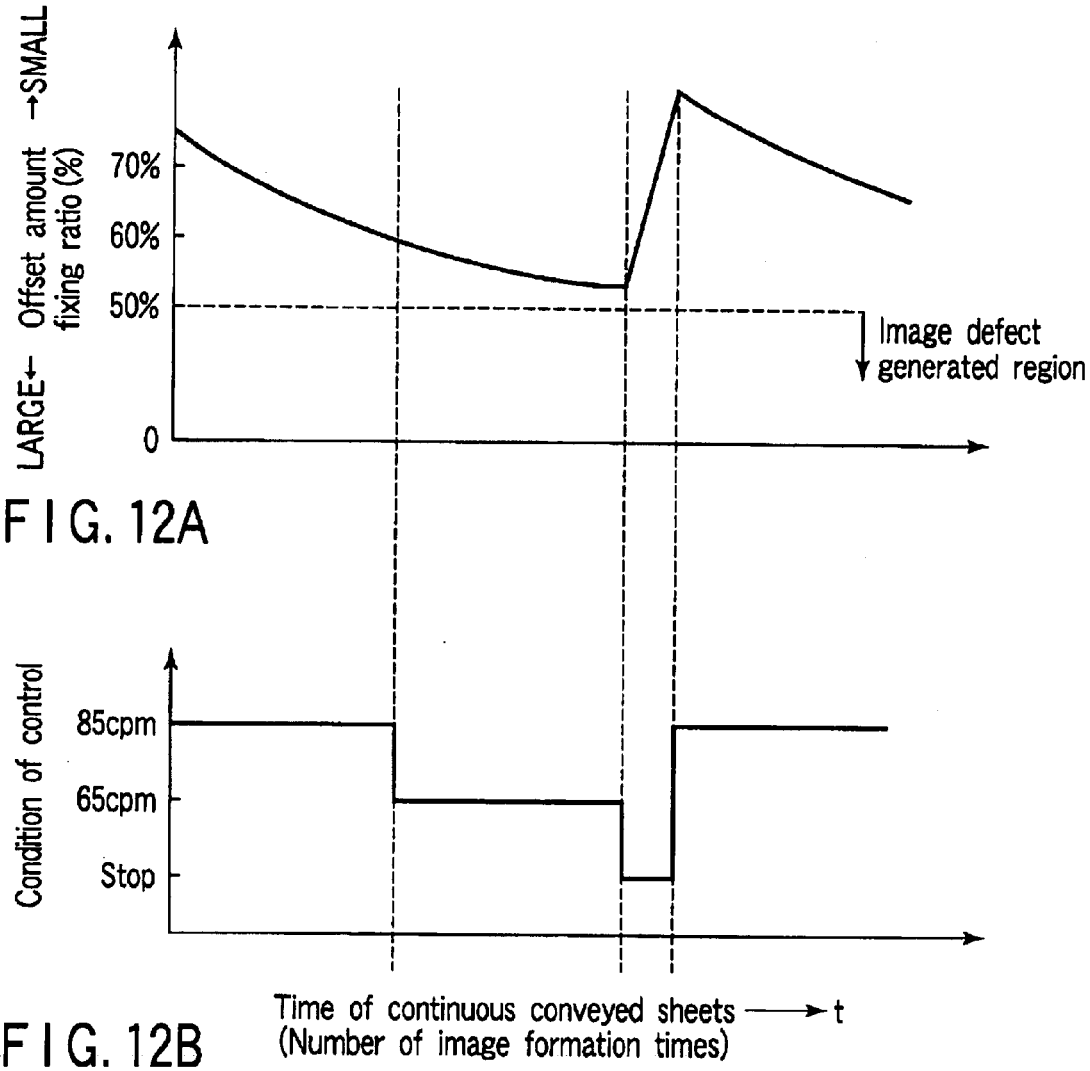
FIGS. 12A and 12B are schematic diagrams showing that the control of the feed amount of the web shown in FIGS. 10 and 11 is used, and thereby the image defect, that is, the degree of generation of adhesion of the toner onto the surface of the transferred material is reduced.
FIG. 13 is a schematic diagram showing a relation between a pre-run operation control for rotating a pressure-rised roller for the purpose of setting heat distribution of the pressure-rised roller to be uniform in a state in which the temperatures of the peripheral surfaces of the heating roller and pressure-rised roller of the fixing apparatus are raised to a predetermined standby temperature, and the temperature of the pressure-rised roller.

As apparent from FIGS. 12A and 12B, it is recognized that with the use of the control of the feed amount of the web shown in FIGS. 10 and 11, the degree of generation of image defect (such as the adhesion of the toner onto the surface of the sheet (transferred material)) is reduced.

FIG. 13 shows an example of a control of temperature of the pressure-rised roller by a pre-run operation control for rotating the heating roller (and the pressure-rised roller rotated following the heating roller) for the purpose of setting heat distribution of the pressure-rised roller to be uniform in a state in which the temperatures of the peripheral surfaces of the heating roller and pressure-rised rollers shown in FIGS. 2 and 3 are raised to a predetermined standby temperature in the copying machine shown in FIG. 1.

As shown in FIG. 13, in a standby time in which the temperature of the outer peripheral surface of the heating roller 2 is raised to the predetermined standby temperature, the pressure-rised roller 3 is rotated every constant time interval usually in order to inhibit the temperature of a specific region of the pressure-rised roller 3 from rising. For example, when the copying machine shown in FIG. 1 includes the fixing apparatus 1 shown in FIGS. 2 and 3, the temperature of the pressure-rised roller 3 on standby is preferably maintained at about 130° C.

Therefore, when the temperature of the peripheral surface of the pressure-rised roller 3 is, for example, below 110° C., the pre-run operation of driving the fixing motor 123 and rotating the pressure-rised roller 3 for the predetermined time is known.

Additionally, in the pre-run operation, when the temperature of the pressure-rised roller 3 is raised at about 130° C., the rotation of the roller 3 is stopped.

Figure 14A:
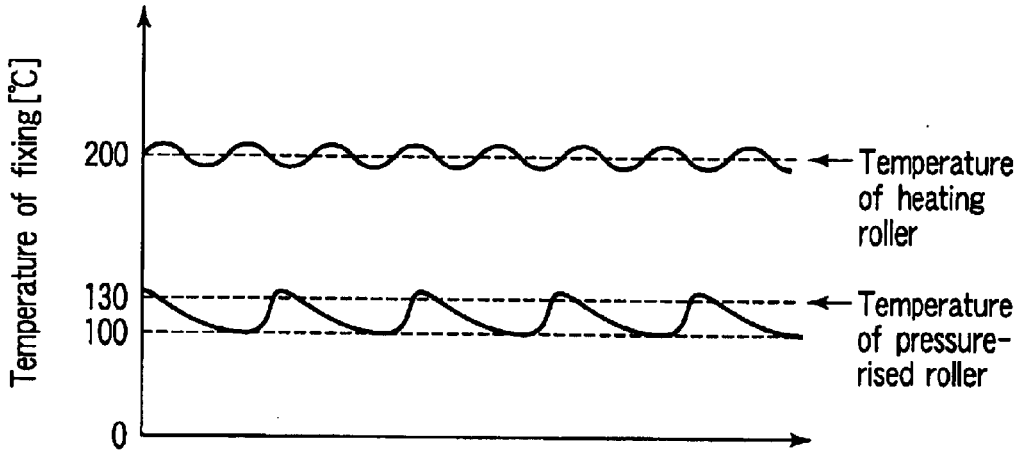
FIGS. 14A and 14B are schematic diagrams showing one example of idling of the heating roller and the changes of temperatures of the heating roller and pressure-rised roller shown in FIG. 13.
Figure 14B:
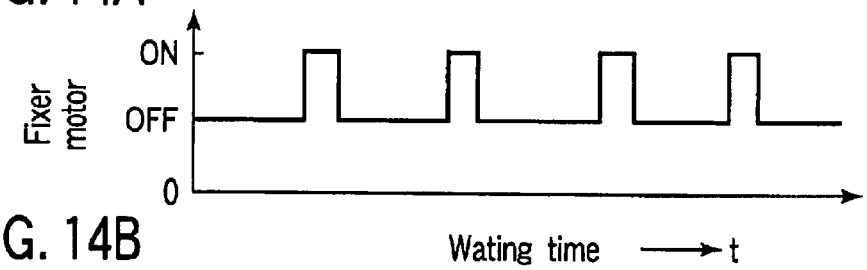

In this case, the temperatures of the peripheral surfaces of the heating roller 2 and pressure-rised roller 3 are maintained in a constant range as shown in FIG. 14A. Additionally, the web motor 125 is rotated for a predetermined time every constant time as shown in FIG. 14B. Therefore, the toner is transferred to the web 21 of the web cleaner 6 from the heating roller 2.

Figure 15:
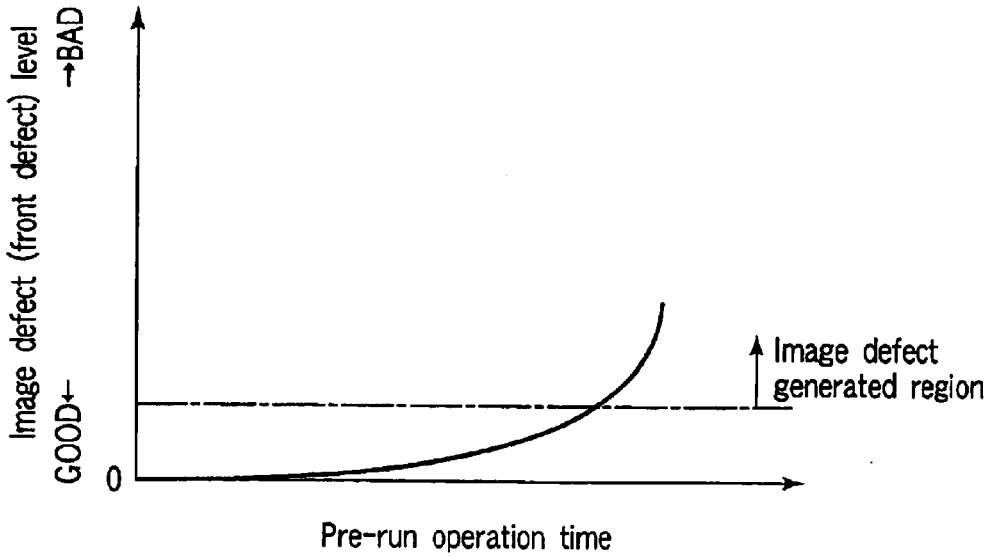
FIG. 15 is a schematic diagram showing a total of a pre-run operation time and the image defect, that is, the degree of generation of adhesion of the toner onto the surface of the transferred material, when the pre-run operation shown in FIGS. 13, 14A and 14B is not performed.

Therefore, it is known that the toner adheres to the web 21, and the web 21 becomes dirty by the toner during the standby time in accordance with a total of a time for rotating the heating roller 2 by the pre-run operation shown in FIG. 15.

Therefore, as shown in FIG. 16, a slight amount of web 21 of the web cleaner 6 is taken up by the recovering member 23 in accordance with the total of the pre-run operation time shown in FIG. 15. That is, even in standby, the web 21 is moved every predetermined amount at the predetermined timing, and a position of the web 21 in contact with the peripheral surface of the heating roller 2 is changed. Therefore, although the optional portion of the web 21 becomes dirty with the toner, the toner can be prevented from adhering to the heating roller 2 again.

For example, as shown in FIG. 16, when the total time of the pre-run operation is within 10 min., and when the output of print out is instructed and the image formation is started, the web 21 is taken up by 0.3 mm. When the total time is within 20 min. (10 min. or more), and when the image formation is instructed, the web 21 is taken up by 1.5 mm.

Additionally, when the total time of the pre-run operation exceeds 20 min., and when the image formation is instructed, the web 21 is taken up by 3.0 mm (the whole region of the web 21 contacting the roller 2 is replaced with an unused region).

Figure 17:
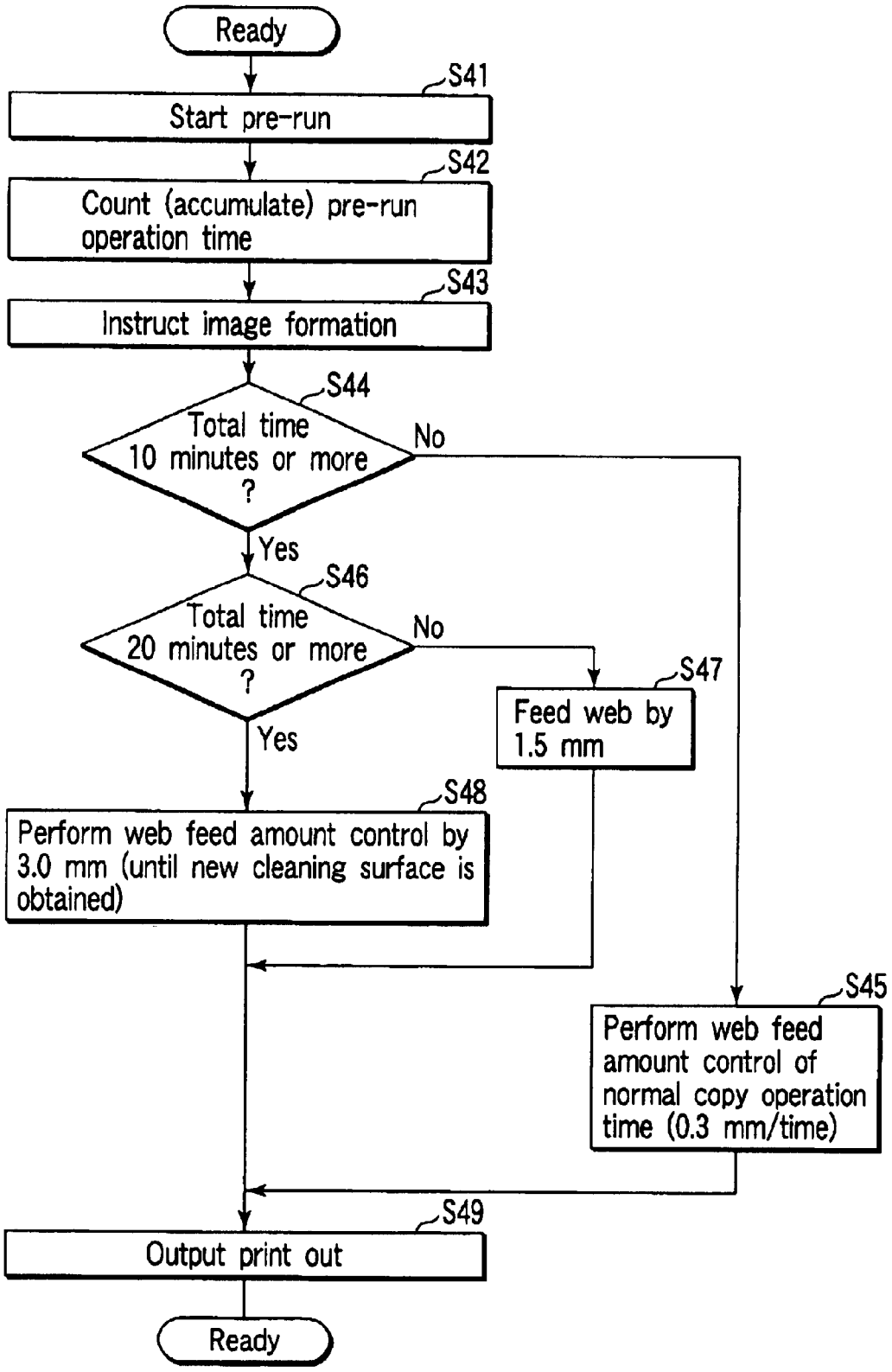
FIG. 17 is a flowchart showing the control of the feed amount of the web with respect to the total of pre-run operation time shown in FIG. 16 in more detail.

FIG. 17 is a flowchart showing the control of the feed amount of the web with respect to the total of the pre-run operation time shown in FIG. 16 in more detail.

As shown in FIG. 17, when the power is supplied to the exciting coil 11, the temperature of the heating roller 2 is raised to the predetermined standby temperature, and the predetermined time elapses, the fixing motor 123 is rotated for the predetermined time in order to set the heat distribution of the pressure-rised roller 3 to be uniform.

That is, the heating roller 2 and pressure-rised roller 3 are rotated for the predetermined time (S41).

Thereafter, a rotation time (pre-run time) for which the heating roller 2 and pressure-rised roller 3 are rotated is counted by the counter C (S42).

The output of print out is instructed via the control panel 141 at the optional timing (S43), and it is then judged whether or not the total of pre-run time is within 10 min. (S44). Then, it is judged that the total of pre-run time is within 10 min. (S44—Yes), and the web 21 of the web cleaner 6 is taken up, for example, by 0.3 mm (S45).

In step S44, it is judged that the total of pre-run time is longer than 10 min. (S44—No), and it is then judged whether or not the total of pre-run time is within 20 min. (S46). Then, it is judged in step S46 that the total of pre-run time is within 20 min. (S46—Yes), and the web 21 of the web cleaner 6 is taken up, for example, by 1.5 mm (S47). It is judged in step S46 that the total of pre-run time is longer than 20 min. (S46—No), and the web 21 of the web cleaner 6 is taken up, for example, by 3.0 mm. That is, when the total of pre-run time is longer than 20 min., the whole region of the web 21 in contact with the peripheral surface of the heating roller 2 is replaced with an unused region never having contacted the peripheral surface of the heating roller 2 (S48).

Thereafter, an instructed number of copies of print out are outputted (S49).

As shown in FIG. 18, with the use of the control of the feed amount of the web shown in FIGS. 16 and 17, the degree of generation of image defects (such as the adhesion of the toner onto the surface of the sheet) is reduced, and the sheet is prevented from becoming dirty by the toner.

FIG. 19 is a schematic diagram showing one example of the change of temperature of the heating roller during the output of print out immediately after the end of the warm-up and the degree of generation of image defects (such as the adhesion of the toner onto the surface of the sheet).

As shown in FIG. 19, in a case in which the temperature of the environment with the apparatus set therein is lower than 20° C., and the time necessary for the warm-up is long immediately after the turning-on of the copying machine or the printer, for example, at the beginning (morning) of the day in the low-temperature state in the apparatus, and in a case in which the environment temperature with the apparatus set therein is higher than 20° C., and the time necessary for the warm-up is short, the degree of generation of image defects (such as the adhesion of the toner onto the surface of the sheet) differs. Additionally, in an example in which the warm-up time is longer than the predetermined time, for example, the copying machine 101 shown in FIG. 1 includes the fixing apparatus 1 shown in FIGS. 2 and 3, and the warm-up time is 30 seconds or more. Needless to say, the warm-up time is separately set depending on the number of copies of print out per minute required for the copying machine 101 and/or the power situation (maximum input power) of the country or the region in which the copying machine 101 is installed. The curve a shows that the temperature of the heating roller 2 changes during continuous print out, but a temperature of 180° C. or more is secured regardless of the number of times (copies) of print out, in a case in which the above-described warm-up time is shorter than the predetermined time (30 seconds in this example), and the temperature of the heating roller 2 of the fixing apparatus 1 is about 200° C. in standby.

On the other hand, as shown by the curve b, even when the temperature of the heating roller 2 of the fixing apparatus 1 is about 200° C. in standby, the temperature becomes lower than 180° C. by the continuous output of print out, and the generation of the image defects is recognized.

Additionally, as shown in FIG. 5, when the number of times of continuous image formation exceeds 50 (the number of copies of print out exceeds 50), the temperature inside the copying machine 101 also rises, and the temperature of the heating roller 2 is not less than 180° C.

Therefore, as the cause for the generation of the image defect, for example, "the warm-up time until the temperature of the heating roller 2 reaches the temperature in standby" is "longer than the predetermined time". Even in this case, it is seen that only the time required for the temperature inside the copying machine 101 to rise may be considered.

FIG. 20 shows one example of the control of the feed amount of the web with respect to the time required for the output of a certain constant number of copies of temperature immediately after the warm-up induction heating low-temperature environment shown in FIG. 19.

As apparent from FIG. 20, for example, even when the temperature of the environment with the copying machine 101 installed therein is higher than 20° C., but when the warm-up time is longer than the predetermined time, for the number of times of output of print out of 50 times (50 copies), the feed amount of the web 21 in the web cleaner 6 is set to be 1.5 times that of the above-described normal operation time. It has been confirmed that by the feed control of the web 21, the image defect is not easily generated. Additionally, since the feed amount of the web 21 of the normal operation time is 0.3 mm every ten sheets of image formation, the web feed amount is 0.45 mm per time in the above-described low-temperature environment.

In this case, for the feed amount of the web 21, referring to the temperature of the peripheral surface of the heating roller 2 of the fixing apparatus 1 detected by the thermistor 7 and the time for the thermistor 7 to detect the predetermined temperature counted by the counter C, the main control apparatus 151 reads temperature control conditions stored in the ROM 153.

Subsequently, the read temperature condition is corrected based on the temperature in the copying machine detected by the temperature sensor 161 disposed in the image forming unit 103 of the copying machine 101 shown in FIG. 4.

Additionally, when the warm-up time is shorter than the predetermined time, as described above, the feed amount of the web 21 corresponds to the normal condition, that is, 0.3 mm every ten sheets of image formation.

On the other hand, for example, when the temperature of the environment with the copying machine 101 installed therein is lower than 20° C., and when the warm-up time is longer than the predetermined time, for the number of times of output of print out of 50 times (50 copies), the feed amount of the web 21 in the web cleaner 6 is set to be twice that of the above-described normal operation time.

It has been confirmed that by the feed control of the web 21, the image defect is not easily generated.

Additionally, since the feed amount of the web 21 of the normal operation time is 0.3 mm every ten sheets of image formation, the web feed amount is 0.6 mm per time in the above-described low-temperature environment.

Moreover, when the warm-up time is shorter than the predetermined time (30 seconds), for the number of times of output of print out of 50 times (50 copies), the feed amount of the web 21 is set to be 1.5 times (0.45 mm) that of the above-described normal operation time.

Additionally, in this case, when the number of times of continuous output of print out exceeds 50 times (50 copies), the feed amount of the web 21 is returned to 0.3 mm/10 sheets.

Figure 21:
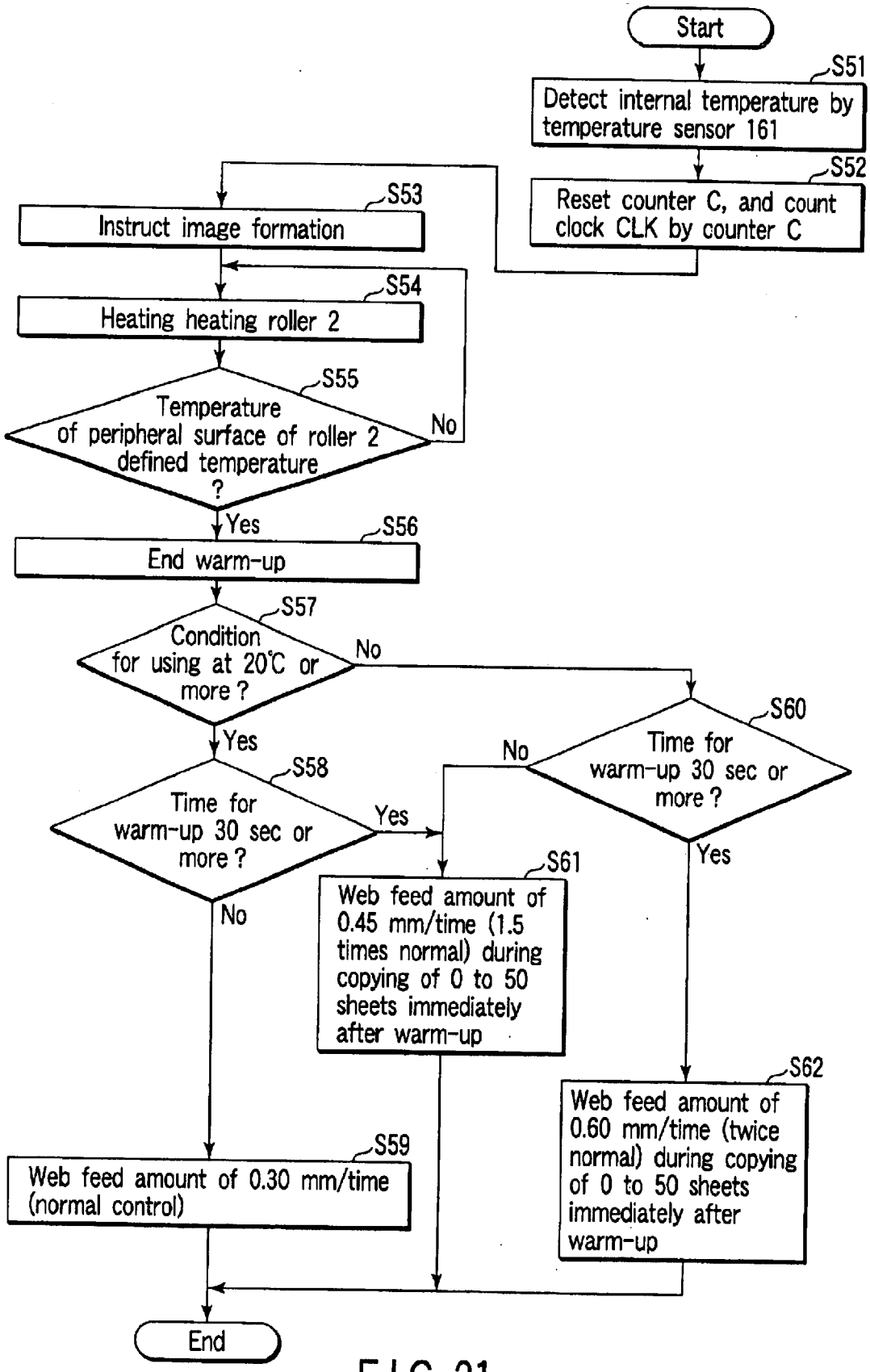
FIG. 21 is a flowchart showing one example of the control of the web feed amount concerning the time required for outputting the certain constant number of copies of print out immediately after the warm-up in the low-temperature environment shown in FIG. 20 in detail.

FIG. 21 is a flowchart showing one example of the web feed amount within the time required for outputting the certain constant number of copies of print out immediately after warm-up in the low-temperature environment shown in FIG. 20 in detail.

As shown in FIG. 21, when the power switch (not shown) of the copying machine 101 is turned ON, the temperature in the copying machine 101 detected by the temperature sensor 161 is referred to (S51).

Additionally, the counter C as the firmware of the main control apparatus 151 (or added to the main control apparatus 151) is reset, and simultaneously the clock CLK generated by the clock generator R is counted (S52).

When the control panel 141 instructs the output of print out (image formation) with respect to the image information read by the ADF 104 or the image information supplied from the external apparatus, the high-frequency output with the predetermined frequency is supplied to the exciting coil 11 (S53).

Thereby, the temperature of the heating roller 2 is raised (S54).

The temperature of the heating roller 2 is raised to the predetermined temperature by the eddy current generated by supplying the current to the exciting coil 11 (S55—Yes), and the warm-up ends (S56). Then, it is judged based on the output of the temperature sensor 161 referred to in the step S51 whether or not the temperature of the environment with the copying machine 101 installed therein is 20° C. or more (S57) When the temperature of the place with the copying machine 101 installed therein is judged to be 20° C. or more (S57—Yes), the counter value started to be counted in step S52 is referred to. It is judged whether or not the time required for the warm-up is longer than the predetermined time, such as 30 seconds (S58).

When the time required for the warm-up is less than 30 seconds in the step S58 (S58—Yes), the web 21 of the web cleaner 6 is taken up at a ratio of 0.3 mm/10 sheets (S59).

When the environment temperature is less than 20° C. in the step S57 (S57—No), the counter value started to be counted in step S52 is referred to. It is judged whether or not the time required for the warm-up is longer than the predetermined time (S60).

The time required for the warm-up is detected to be less than 30 seconds in step S60 (S60—No). In this case, only until the number of times of output of print out reaches 50 times (50 copies) from the start of image formation, the web feed amount is set to be 1.5 times (0.45 mm) that of the normal operation time (S61).

On the other hand, the time required for the warm-up is detected to be longer than 30 seconds in step S60 (S60—Yes). In this case, only until the number of times of output of print out reaches 50 times (50 copies) from the start of image formation, the web feed amount is set to be twice (0.6 mm) that of the normal operation time (S62).

Additionally, in step S58, the time required for the warm-up is longer than 30 seconds (S58—Yes). Similarly as a case in which the temperature of the installation environment is less than 20° C. and the warm-up time is less than 30 seconds, only until the number of times of output of print out reaches 50 times (50 copies) from the start of image formation, the web feed amount is set to be 1.5 times (0.45 mm) that of the normal operation time (S61).

Figure 22:
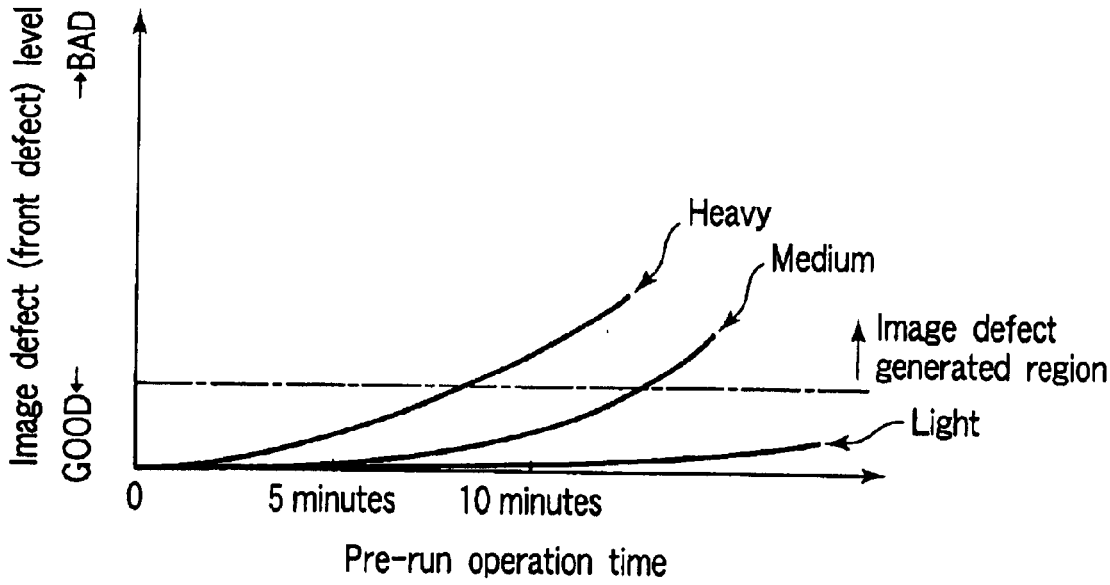
FIG. 22 is a schematic diagram showing the above-described total of pre-run operation time, the amount of toner adhering to the web, and the image defect, that is, the degree of generation of adhesion of the toner onto the surface of the transferred material.

FIG. 22 is a schematic diagram showing the above-described total of pre-run operation time, the amount of toner adhering to the web, and the degree of generation of the image defect (such as the adhesion of the toner onto the surface of the transferred material).

In FIG. 22, a curve a shows the dirt of the web 21 (toner adhering amount) in a case in which the image information included in the previous output of print out includes a high-density image by not less than a predetermined ratio.

Additionally, in one example of the condition in which the high-density image is included by not less than the predetermined ratio, an average image occupied ratio as a ratio at which an area with the image having not less than the predetermined density present on the sheet occupies the whole area of the sheet is 10% or more.

Similarly, curve b shows the dirt of the web 21 in a case in which the image information included in the previous output of print out includes a normal linear image (the average image occupied ratio is less than 10% and not less than 5%).

Moreover, curve c shows the dirt of the web 21 in a case in which the image information included in the previous output of print out is remarkably little small-sized linear image, or a read object is turned over by mistake, that is, the sheet substantially corresponds to a blank sheet (average image occupied ratio is less than 5%).

FIG. 23 shows one example of the control of the web feed amount using the total of pre-run operation time shown in FIG. 22 and the amount of toner adhering to the web as parameters.

As described above with reference to FIGS. 14A and 14B, the heating roller 2 and pressure-rised roller 3 are rotated for the predetermined time every predetermined time during the pre-run operation. Therefore, the toner is transferred to the web 21 of the web cleaner 6 from the heating roller 2.

Naturally, as described above with reference to FIG. 15, it is known that the toner adheres to the web 21 in accordance with the total of the time for rotating the heating roller 2 by the pre-run operation, and the web 21 on standby becomes dirty with toner.

Additionally, as shown in FIG. 22, the image density of the image information included in the previous output of print out also influences the amount of the toner adhering to the web 21.

Therefore, as shown in FIG. 23, the web 21 of the web cleaner 6 is slightly taken up by the recovering transferred member 23 in accordance with the image density of the image information included in the previous output of print out and the total of pre-run operation time.

That is, even in standby, the web 21 is moved every predetermined amount at the predetermined timing, and the position of the web 21 contacting the peripheral surface of the heating roller 2 is changed. Therefore, although the optional portion of the web 21 is contaminated by the toner, the toner can be prevented from again adhering to the heating roller 2.

For example, as shown in FIG. 23, when the image density of the image information included in the previous print out is high (average image occupied ratio is 10% or more), and the total time of pre-run operation is less than 5 min., and when the output of print out is instructed and the image formation is started, the web 21 is taken up by 0.3 mm. When the total time is 5 min. or more, and when the image formation is instructed, the web 21 is taken up by 3.0 mm (the whole region of the web 21 contacting the heating roller 2 is replaced with the unused region).

Similarly, when the image density of the image information included in the previous output of print out is substantially the density of the linear image (average image occupied ratio is less than 10% and 5% or more), and the total time of pre-run operation is less than 10 min., and when the output of print out is instructed and the image formation is started, the web 21 is taken up by 0.3 mm. When the total time is 10 min. or more, and the image formation is instructed, the web 21 is taken up by 3.0 mm (the whole region of the web 21 contacting the heating roller 2 is replaced with the unused region).

On the other hand, when the image density of the image information included in the previous output of print out is remarkably low (with substantially the blank sheet) (average image occupied ratio is less than 5%), and the total time of pre-run operation is less than 30 min., and when the output of print out is instructed and the image formation is started, the web 21 is taken up by 0.3 mm. Additionally, when the total time exceeds 30 min., and the image formation is instructed, the web 21 is taken up by 3.0 mm (the whole region of the web 21 contacting the heating roller 2 is replaced with the unused region).

Figure 24:
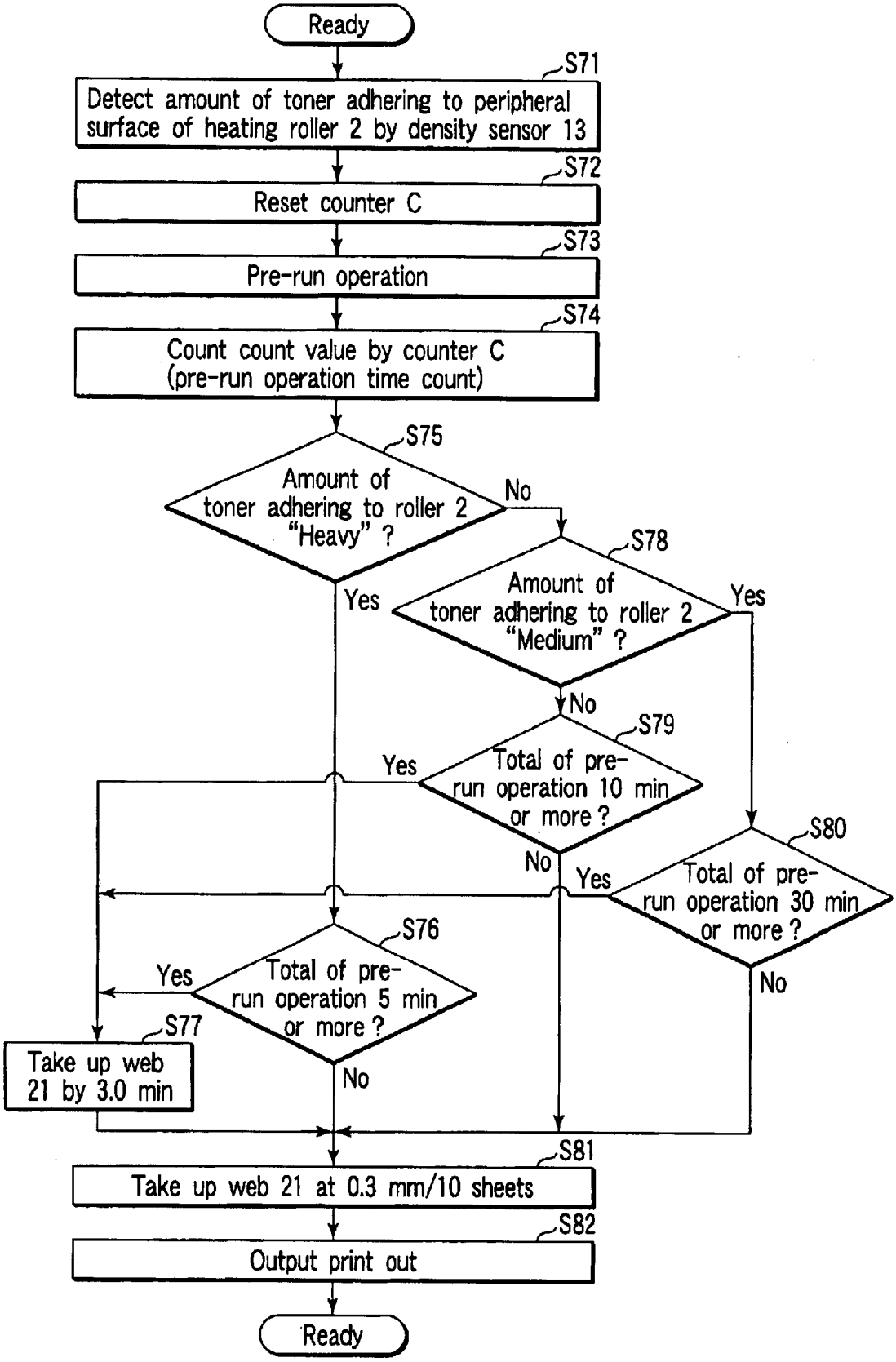
FIG. 24 is a flowchart showing one example of the control of the feed amount of the web using the total of pre-run operation time and the amount of toner adhering to the web shown in FIG. 23 as parameters in detail.

FIG. 24 is a flowchart showing one example of the control of the feed amount of the web using the total of pre-run operation time shown in FIG. 23 and the amount of toner adhering to the web as the parameters in detail.

As shown in FIG. 24, for example, by the density sensor 13 disposed in the vicinity of the stripping claw 5, the main control apparatus 151 monitors the degree (amount) of the toner adhering to the surface of the heating roller 2 (S71).

Simultaneously, or at the predetermined timing, the counter C for counting the pre-run operation time is reset (S72).

Subsequently, when the power is supplied to the exciting coil 11, the temperature of the heating roller 2 is raised to the predetermined standby temperature, and the predetermined time elapses, the fixing motor 123 is rotated for the predetermined time in order to set the heat distribution of the pressure-rised roller 3 to be uniform. That is, the heating roller 2 and pressure-rised roller 3 are rotated for the predetermined time (S73).

Thereafter, the rotation time (pre-run time) for which the heating roller 2 and pressure-rised roller 3 are rotated is counted by the counter C (S74).

When the output of print out is instructed from the control panel 141 at the optional timing, the output from the density sensor 13 is referred to, and the degree of the toner adhering to the peripheral surface of the heating roller 2 after the previous output of print out is monitored. It is then judged whether or not the average image occupied ratio is 10% or more (the dirt of the roller 2 is "heavy" or except "heavy") (S75).

When the degree of the dirt on the peripheral surface of the heating roller 2 is detected to be "heavy" in step S75 (S75—Yes), it is judged whether or not the total of pre-run time is 5 min. or more (S76).

When the total of pre-run time is recognized to be 5 min. or more in step S76 (S76—Yes), the web 21 of the web cleaner 6 is taken up, for example, by about 3.0 mm.

That is, when the dirt of the roller 2 is "heavy", and the total of pre-run time is longer than 5 min, the whole region of the web 21 contacting the peripheral surface of the heating roller 2 is replaced with the unused region of the web never having contacted the peripheral surface of the heating roller 2 (S77).

When the total of pre-run time is judged to be less than 5 min. in step S76 (S76—No), the normal operation is set, and the web 21 is taken up, for example, at a level of 0.3 mm/10 times (S81).

On the other hand, the dirt of the peripheral surface of the roller 2 is "medium" less than "heavy" (S75—No). Then, it is further judged whether or not the degree of the dirt on the peripheral surface of the heating roller 2 is "light" less than "medium" (S78).

In step S78, it is detected that the dirt of the heating roller 2 is "medium" (S78—No). It is then judged whether or not the total of pre-run time is 10 min. or more (S79).

When the total of pre-run time is judged to be 10 min. or more in step S79 (S79—Yes), the web 21 of the web cleaner 6 is taken up, for example, by about 3.0 mm.

That is, even when the dirt of the roller 2 is "medium", but when the total of pre-run time is longer than 10 min., the whole region of the web 21 contacting the peripheral surface of the heating roller 2 is replaced with the unused region never having contacted the peripheral surface of the heating roller 2 (S77).

Additionally, when the total of pre-run time is judged to be less than 10 min. in step S79 (S79—No), the normal operation is set, and the web 21 is taken up, for example, at a level of 0.3 mm/10 times (S81).

In step S78, it is detected that the dirt of the heating roller 2 is "light" (S78—Yes). Then it is judged whether or not the total of pre-run time is 30 min. or more (S80).

When the total of pre-run time is detected to be 30 min. or more in step S80 (S80—Yes), the web 21 of the web cleaner 6 is taken up, for example, by about 3.0 mm.

That is, even when the dirt of the roller is "light", but when the total of pre-run time exceeds 30 min., the whole region of the web 21 contacting the peripheral surface of the heating roller 2 is replaced with the unused region never having contacted the peripheral surface of the heating roller 2 (S77).

Moreover, when the total of pre-run time is judged to be 10 min. or more and less than 30 min. in step S80 (S80—No), the normal operation is set, and the web 21 is taken up, for example, at a level of 0.3 mm/10 times (S81).

Additionally, in each step, when and after the web 21 is taken up by 3.0 mm, the normal feed control of the web is executed.

Figure 25:
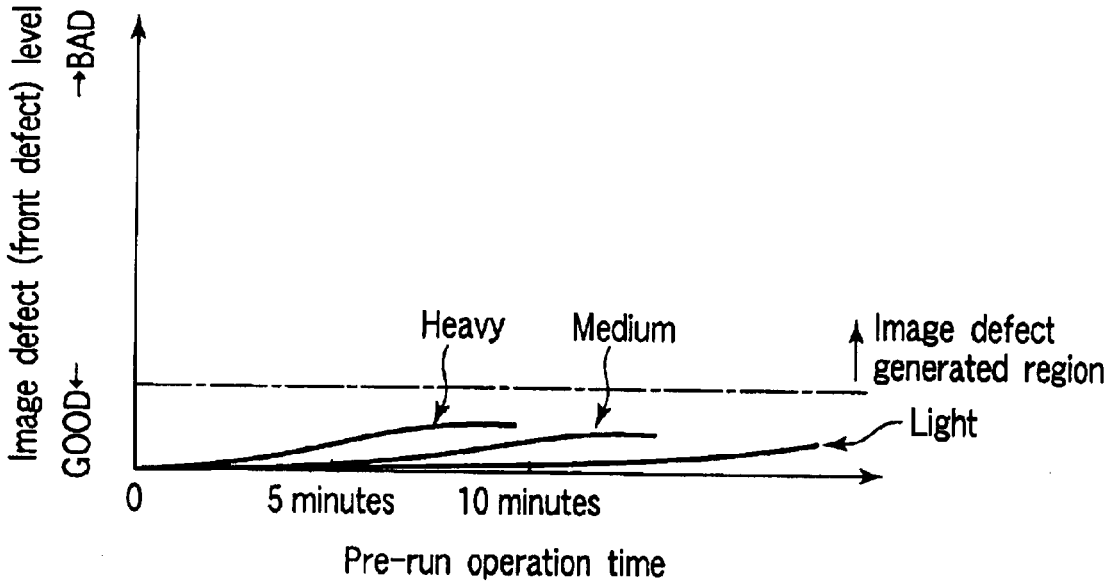
FIG. 25 is a schematic diagram showing that the feed amount of the web is controlled using the total of pre-run operation time and the amount of the toner adhering to the web shown in FIGS. 23 and 24 as parameters, and thereby the image defect, that is, the degree of generation of adhesion of the toner onto the surface of the transferred material is reduced.

As apparent from FIG. 25, when the total of pre-run time and the amount of toner adhering to the web shown in FIGS. 23 and 24 are used as the parameters, and the feed amount of the web is controlled, the degree of generation of the image defect, that is, the adhesion of the toner onto the surface of the sheet can be confirmed to be reduced.

Additionally, similarly as FIG. 25, curves a, b and c show the dirt of the web 21 in a case in which the dirt of the heating roller 2 is "heavy", "medium" and "light".

When the feed amount of the web is optimized based on the amount of the image information included in the previous output of print out and the total time of pre-run operation shown in FIG. 25, the print out having an undesired toner adhering to the image surface can be prevented from being output.

As described above, according to the fixing apparatus with the web cleaner attached thereto of the present invention, the toner adhering to the heating roller does not adhere to the sheet again, and is recovered by the web. On the other hand, the web with the toner adhering thereto is taken up at the predetermined timing and by the predetermined take-up amount, or replaced with the unused region in accordance with the parameters such as the ambient temperature, temperature in the copying machine, amount of image information (average image occupied ratio), and step of setting heat of the rollers on standby to be uniform.

Therefore, the fixing operation of the next material to be fixed is not executed while the toner adheres to the heating roller, and a print out having undesired toner adhering to the image surface can be inhibited from being output.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heating mechanism including:

a heating object which is either a hollow cylinder or an endless belt, and in which a predetermined heat is supplied to a thermally fusible material and a base material holding said thermally fusible material, and either a peripheral surface of said cylinder or a belt surface of said belt, constituting said heating object, is moved at a predetermined speed;

a pressure supply mechanism which supplies a predetermined pressure to said heating object with said thermally fusible material and base material disposed between the pressure supply mechanism and said heating object, and whose peripheral surface is followed and moved by moving either the peripheral surface of said cylinder or the belt surface of said belt, constituting said heating object, at the predetermined speed;

a heating object heating mechanism which is set in said heating object, and allows said heating object to generate heat;

a thermally fusible material recovering member which is brought in contact with the peripheral surface of said cylinder or the belt surface of said belt, constituting said heating object, at the predetermined pressure, and which can recover said thermally fusible material adhering to the peripheral surface of said cylinder or the belt surface of said belt;

a thermally fusible material recovering member renewing mechanism to move a region of said thermally fusible material recovering member brought in contact with the peripheral surface of said cylinder or the belt surface of said belt, constituting said heating object, at the predetermined pressure by a predetermined amount, when a predetermined amount of said thermally fusible material is absorbed by said thermally fusible material recovering member; and a heating object temperature detecting mechanism which detects a temperature of the peripheral surface of said cylinder or the belt surface of said belt, constituting said heating object;

a thermally fusible material recovering member renewing mechanism control apparatus which moves the region of said thermally fusible material recovering member brought into contact with the peripheral surface of said cylinder or the belt surface of said belt, constituting said heating object, at a predetermined timing; and a temperature rise time count mechanism to measure a time necessary for said heating object temperature detecting mechanism to detect that the temperature of the peripheral surface of said cylinder or the belt surface of said belt, constituting said heating object, has reached a predetermined temperature, wherein said thermally fusible material recovering member renewing mechanism control apparatus changes an amount of movement of said thermally fusible material recovering member based on the time counted by said temperature rise time count mechanism, when a region of said thermally fusible material recovering member brought in contact with the peripheral surface of said cylinder or the belt surface of said belt, constituting said heating object, is moved at a predetermined timing.

2. A fixing apparatus according to claim 1, wherein said thermally fusible material recovering member renewing mechanism control apparatus increases the amount of movement of said thermally fusible material recovering member, when the region of said thermally fusible material recovering member brought in contact with the peripheral surface of said cylinder or the belt surface of said belt, constituting said heating object, is moved at the predetermined timing, and when the time counted by said temperature rise time count mechanism is longer than a predetermined time.

3. An image forming apparatus comprising:

a photosensitive member which is given a predetermined potential and irradiated with light and which can hold an image;

an image forming unit which can irradiate said photosensitive member with said light;

a visualizing apparatus which selectively supplies a thermally fusible material to said image held by said photosensitive member and visualizes the image;

a base material conveying apparatus to convey said base material to said photosensitive member so that said thermally fusible material can be transferred to the base material from said photosensitive member, and to guide said base material holding said thermally fusible material between a heating object and pressure supply mechanism of a fixing apparatus;

the fixing apparatus comprising:

a heating mechanism including:

the heating object which is either a hollow cylinder or an endless belt, and in which a predetermined heat is supplied to the thermally fusible material and the base material holding said thermally fusible material, and either a peripheral surface of said cylinder or a belt surface of said belt, constituting said heating object, can be moved at a predetermined speed;

the pressure supply mechanism which supplies a predetermined pressure to said heating object with said thermally fusible material and base material disposed between the pressure supply mechanism and said heating object, and whose peripheral surface is followed and moved by moving either the peripheral surface of said cylinder or the belt surface of said belt, constituting said heating object, at the predetermined speed;

a heating object heating mechanism which is set in said heating object, and allows said heating object to generate a heat;

a thermally fusible material recovering member which is brought in contact with either the peripheral surface of said cylinder or the belt surface of said belt, constituting said heating object, at the predetermined pressure, and which can recover said thermally fusible material adhering to the peripheral surface of said cylinder or the belt surface of said belt;

a thermally fusible material recovering member renewing mechanism to move a region of said thermally fusible material recovering member brought in contact with the peripheral surface of said cylinder or the belt surface of said belt, constituting said heating object, at the predetermined pressure by a predetermined amount, when a predetermined amount of said thermally fusible material is absorbed by said thermally fusible material recovering member; and a heating object temperature detecting mechanism which detects a temperature of the peripheral surface of said cylinder or the belt surface of said belt, constituting said heating object; and a thermally fusible material recovering member renewing mechanism control apparatus which moves the region of said thermally fusible material recovering member brought into contact with the peripheral surface of said cylinder or the belt surface of said belt, constituting said heating object, at a predetermined timing; and an ambient temperature detecting mechanism which measures at least one of an environment temperature with said heating object installed therein, a temperature of said thermally fusible material, and a temperature of said base material holding said thermally fusible material, wherein said thermally fusible material recovering member renewing mechanism control apparatus changes an amount of movement of said thermally fusible material recovering member based on the temperature measured by said ambient temperature detecting mechanism, when a region of said thermally fusible material recovering member brought in contact with the peripheral surface of said cylinder or the belt surface of said belt, constituting said heating object, is moved at a predetermined timing.

4. An image forming apparatus according to claim 3, wherein said thermally fusible material recovering member renewing mechanism control apparatus increases the amount of movement of said thermally fusible material recovering member, when the region of said thermally fusible material recovering member brought in contact with the peripheral surface of said cylinder or the belt surface of said belt, constituting said heating object, is moved at the predetermined timing, and when the temperature measured by said ambient temperature detecting mechanism is lower than a predetermined temperature.

5. An image forming apparatus comprising:

a photosensitive member which is given a predetermined potential and irradiated with light and which can hold an image;

an image forming unit which can irradiate said photosensitive member with said light;

a visualizing apparatus which selectively supplies a thermally fusible material to said image held by said photosensitive member and visualizes the image;

a base material conveying apparatus to convey said base material to said photosensitive member so that said thermally fusible material can be transferred to the base material from said photosensitive member, and to guide said base material holding said thermally fusible material between a heating object and pressure supply mechanism of a fixing apparatus;

the fixing apparatus comprising:

a heating mechanism including:

the heating object which is either a hollow cylinder or an endless belt, and in which a predetermined heat is supplied to the thermally fusible material and the base material holding said thermally fusible material, and either a peripheral surface of said cylinder or a belt surface of said belt, constituting said heating object, is moved at a predetermined speed;

the pressure supply mechanism which supplies a predetermined pressure to said heating object with said thermally fusible material and base material disposed between the pressure supply mechanism and said heating object, and whose peripheral surface is followed and moved by moving either the peripheral surface of said cylinder or the belt surface of said belt, constituting said heating object, at the predetermined speed;

a heating object heating mechanism which is set in said heating object, and allows said heating object to generate heat;

a thermally fusible material recovering member which is brought in contact with either the peripheral surface of said cylinder or the belt surface of said belt, constituting said heating object, at the predetermined pressure, and which can recover said thermally fusible material adhering to the peripheral surface of said cylinder or the belt surface of said belt;

a thermally fusible material recovering member renewing mechanism to move a region of said thermally fusible material recovering member brought in contact with the peripheral surface of said cylinder or the belt surface of said belt, constituting said heating object, at the predetermined pressure by a predetermined amount, when a predetermined amount of said thermally fusible material is absorbed by said thermally fusible material recovering member; and a heating object temperature detecting mechanism which detects a temperature of the peripheral surface of said cylinder or the belt surface of said belt, constituting said heating object; and a thermally fusible material recovering member renewing mechanism control apparatus which moves the region of said thermally fusible material recovering member brought into contact with the peripheral surface of said cylinder or the belt surface of said belt, constituting said heating object, at a predetermined timing;

a temperature rise time count mechanism to measure a time necessary for said heating object temperature detecting mechanism to detect that the temperature of the peripheral surface of said cylinder or the belt surface of said belt, constituting said heating object, has reached a predetermined temperature; and an ambient temperature detecting mechanism which measures at least one of an environment temperature with said heating object installed therein, a temperature of said thermally fusible material, and a temperature of said base material holding said thermally fusible material, wherein said thermally fusible material recovering member renewing mechanism control apparatus increases an amount of movement of said thermally fusible material recovering member, when a region of said thermally fusible material recovering member brought in contact with the peripheral surface of said cylinder or the belt surface of said belt, constituting said heating object, is moved at a predetermined timing, and when the time counted by said temperature rise time count mechanism is longer than a predetermined time, and the temperature measured by said ambient temperature detecting mechanism is lower than a predetermined temperature.

6. An image forming apparatus comprising:

a photosensitive member which is given a predetermined potential and irradiated with light and which can hold an image;

an image forming unit which can irradiate said photosensitive member with said light;

a visualizing apparatus which selectively supplies a thermally fusible material to said image held by said photosensitive member and visualizes the image;

a base material conveying apparatus to convey said base material to said photosensitive member so that said thermally fusible material can be transferred to the base material from said photosensitive member, and to guide said base material holding said thermally fusible material between a heating object and pressure supply mechanism of a fixing apparatus;

the fixing apparatus comprising:

a heating mechanism including:

the heating object which is either a hollow cylinder or an endless belt, and in which a predetermined heat is supplied to the thermally fusible material and the base material holding said thermally fusible material, and either a peripheral surface of said cylinder or a belt surface of said belt, constituting said heating object, is moved at a predetermined speed;

the pressure supply mechanism which supplies a predetermined pressure to said heating object with said thermally fusible material and base material disposed between the pressure supply mechanism and said heating object, and whose peripheral surface is followed and moved by moving either the peripheral surface of said cylinder or the belt surface of said belt, constituting said heating object, at the predetermined speed;

a heating object heating mechanism which is set in said heating object, and allows said heating object to generate heat;

a thermally fusible material recovering member which is brought in contact with either the peripheral surface of said cylinder or the belt surface of said belt, constituting said heating object, at the predetermined pressure, and which can recover said thermally fusible material adhering to the peripheral surface of said cylinder or the belt surface of said belt;

a thermally fusible material recovering member renewing mechanism to move a region of said thermally fusible material recovering member brought in contact with the peripheral surface of said cylinder or the belt surface of said belt, constituting said heating object, at the predetermined pressure by a predetermined amount, when a predetermined amount of said thermally fusible material is absorbed by said thermally fusible material recovering member; and a heating object temperature detecting mechanism which detects a temperature of the peripheral surface of said cylinder or the belt surface of said belt, constituting said heating object; and a thermally fusible material recovering member renewing mechanism control apparatus which moves the region of said thermally fusible material recovering member brought into contact with the peripheral surface of said cylinder or the belt surface of said belt, constituting said heating object, at a predetermined timing;

a base material conveying timing setting apparatus to set a timing at which said base material conveying apparatus conveys said base material to said photosensitive member; and an image formation times number setting apparatus to set the number of times of irradiating of said photosensitive member with said light and the number of times of conveying of said base material to said photosensitive member by said base material conveying apparatus, so that said thermally fusible material can be supplied to said photosensitive member by said image forming unit, wherein said image formation times number setting apparatus can change the timing, set by said base material conveying timing setting apparatus, for conveying said base material to said photosensitive member by said base material conveying apparatus, and a timing for irradiating said photosensitive member with said light by said image forming unit, based on the temperature of the peripheral surface of said cylinder or the belt surface of said belt, constituting said heating object, which is detected by said heating object temperature detecting mechanism.

7. An image forming apparatus according to claim 6, wherein said image formation times number setting apparatus increases intervals of the timing, set by said base material conveying timing setting apparatus, for conveying said base material to said photosensitive member by said base material conveying apparatus and timing for irradiating said photosensitive member with said light by said image forming unit, when the temperature of the peripheral surface of said cylinder or the belt surface of said belt, constituting said heating object, detected by said heating object temperature detecting mechanism is lower than a predetermined temperature, and wherein said thermally fusible material recovering member renewing mechanism control apparatus increases an amount of movement of said thermally fusible material recovering member depending on the number of times of image formation set by said image formation times number setting apparatus, when a region of said thermally fusible material recovering member brought in contact with the peripheral surface of said cylinder and the belt surface of said belt, constituting said heating object, is moved at a predetermined timing.

8. An image forming apparatus according to claim 6, wherein said image formation times number setting apparatus temporarily stops the conveying of said base material to said photosensitive member by said base material conveying apparatus set by said base material conveying timing setting apparatus and the irradiating of said photosensitive member with said light by said image forming unit, when the temperature of the peripheral surface of said cylinder or the belt surface of said belt, constituting said heating object, detected by said heating object temperature detecting mechanism is a temperature to discontinue the image formation, and wherein said thermally fusible material recovering member renewing mechanism control apparatus moves a region of said thermally fusible material recovering member brought in contact with the peripheral surface of said cylinder and the belt surface of said belt, constituting said heating object, to a region not contacting the peripheral surface of said cylinder and the belt surface of said belt, constituting said heating object.

9. An image forming apparatus comprising:

a photosensitive member which is given a predetermined potential and irradiated with light and which can hold an image;

an image forming unit which can irradiate said photosensitive member with said light;

a visualizing apparatus which selectively supplies a thermally fusible material to said image held by said photosensitive member and visualizes the image;

a base material conveying apparatus to convey said base material to said photosensitive member so that said thermally fusible material can be transferred to the base material from said photosensitive member, and to guide said base material holding said thermally fusible material between a heating object and pressure supply mechanism of a fixing apparatus;

the fixing apparatus comprising:

a heating mechanism including:

the heating object which is either a hollow cylinder or an endless belt, and in which a predetermined heat is supplied to the thermally fusible material and the base material holding said thermally fusible material, and either a peripheral surface of said cylinder or a belt surface of said belt, constituting said heating object, is moved at a predetermined speed;

the pressure supply mechanism which supplies a predetermined pressure to said heating object with said thermally fusible material and base material disposed between the pressure supply mechanism and said heating object, and whose peripheral surface is followed and moved by moving either the peripheral surface of said cylinder or the belt surface of said belt, constituting said heating object, at the predetermined speed;

a heating object heating mechanism which is set in said heating object, and allows said heating object to generate heat;

a thermally fusible material recovering member which is brought in contact with either the peripheral surface of said cylinder or the belt surface of said belt, constituting said heating object, at the predetermined pressure, and which can recover said thermally fusible material adhering to the peripheral surface of said cylinder or the belt surface of said belt;

a thermally fusible material recovering member renewing mechanism to move a region of said thermally fusible material recovering member brought in contact with the peripheral surface of said cylinder or the belt surface of said belt, constituting said heating object, at the predetermined pressure by a predetermined amount, when a predetermined amount of said thermally fusible material is absorbed by said thermally fusible material recovering member; and a heating object temperature detecting mechanism which detects a temperature of the peripheral surface of said cylinder or the belt surface of said belt, constituting said heating object; and a thermally fusible material recovering member renewing mechanism control apparatus which moves the region of said thermally fusible material recovering member brought into contact with the peripheral surface of said cylinder or the belt surface of said belt, constituting said heating object, at a predetermined timing; and an ambient temperature detecting mechanism which measures at least one of an environment temperature with said heating object installed therein, a temperature of said thermally fusible material, and a temperature of said base material holding said thermally fusible material, wherein said thermally fusible material recovering member renewing mechanism control apparatus changes an amount of movement of said thermally fusible material recovering member in accordance with an idling operation time, when a region of said thermally fusible material recovering member brought in contact with the peripheral surface of said cylinder or the belt surface of said belt, constituting said heating object, is moved at a predetermined timing, and a predetermined time of an idling operation time is included for which said base material conveying apparatus does not convey said base material and the peripheral surface of said cylinder or the belt surface of said belt, constituting said heating object of said heating mechanism, is moved.

10. An image forming apparatus according to claim 9, wherein said thermally fusible material recovering member renewing mechanism control apparatus moves a region of said thermally fusible material recovering member brought in contact with the peripheral surface of said cylinder or the belt surface of said belt, constituting said heating object, to a region not contacting the peripheral surface of said cylinder or the belt surface of said belt, constituting said heating object, when said idling operation time is longer than a reference time, and when the image formation is instructed.

11. An image forming apparatus according to claim 9, further comprising:

a heating object state detecting mechanism which monitors an amount of said thermally fusible material adhering to said heating object, wherein said thermally fusible material recovering member renewing mechanism control apparatus changes an amount of movement of said thermally fusible material recovering member in accordance with the amount of said thermally fusible material adhering to said heating object, detected by said heating object state detecting mechanism, when a region of said thermally fusible material recovering member brought in contact with the peripheral surface of said cylinder or the belt surface of said belt, constituting said heating object, is moved at a predetermined timing.

12. An image forming apparatus according to claim 11, wherein said thermally fusible material recovering member renewing mechanism control apparatus changes an amount of movement of said thermally fusible material recovering member in accordance with the amount of said thermally fusible material adhering to said heating object, detected by said heating object state detecting mechanism, and a length of said idling operation time, when a region of said thermally fusible material recovering member brought in contact with the peripheral surface of said cylinder or the belt surface of said belt, constituting said heating object, is moved at a predetermined timing.

* * * * *